US010829929B1

(12) United States Patent
Hansen

(10) Patent No.: US 10,829,929 B1
(45) Date of Patent: Nov. 10, 2020

(54) SYSTEM AND METHOD FOR ASSEMBLING STRUCTURAL INSULATED PANELS

(71) Applicant: Greggory Hansen, Lafayette, CA (US)

(72) Inventor: Greggory Hansen, Lafayette, CA (US)

( * ) Notice: Subject to any disclaimer, the term of this patent is extended or adjusted under 35 U.S.C. 154(b) by 0 days.

(21) Appl. No.: 16/721,834

(22) Filed: Dec. 19, 2019

(51) Int. Cl.
*E04B 1/61* (2006.01)
*E04B 1/14* (2006.01)

(52) U.S. Cl.
CPC ..... *E04B 1/6162* (2013.01); *E04B 1/14* (2013.01)

(58) Field of Classification Search
CPC ..... E04B 2002/7461; E04B 2002/7474; E04B 2002/0243; E04B 2002/0245; E04B 2002/0247; E04B 1/6145; E04B 1/6162; E04B 1/14; E04B 1/6137; E04B 1/6141; E04B 2/7425; E04B 2/705; E04B 2/7433; E04B 2/7437; E04B 2/7444; E04B 2002/7446; E04B 2002/7462; E04B 2002/7464; E04B 2002/7487; E04C 2/296; E04C 2/292; F16B 5/0052; A63D 33/105; E04F 2201/05
USPC ..... 52/794.1, 464, 586.1, 586.2, 585.1
See application file for complete search history.

(56) References Cited

U.S. PATENT DOCUMENTS 468,435 A * 2/1892 Brock ..... E04C 2/292 52/792.1
1,018,987 A * 2/1912 Vertiska ..... E04F 15/04 52/177
1,537,678 A * 5/1925 Jensen ..... E06B 3/9845 403/294
1,695,553 A * 12/1928 Jones ..... A63H 33/105 52/281
1,723,306 A * 8/1929 Sipe ..... E04B 1/615 52/396.04
1,799,729 A * 4/1931 Cadwallader ..... E04F 15/04 52/586.1
2,018,911 A * 10/1935 Brill ..... E04B 1/6112 52/232

(Continued)

FOREIGN PATENT DOCUMENTS

CN 101942882 A 1/2011
CN 106320564 A 1/2017

(Continued)

OTHER PUBLICATIONS

Structural Insulated Panels (SIPS). URL: https://basc.pnnl.gov/resource-guides/structural-insulated-panels-sips#quicktabs-guides=1; Date Accessed: Mar. 19, 2019.

(Continued)

*Primary Examiner* — Kyle J. Walraed-Sullivan
(74) *Attorney, Agent, or Firm* — Brian Beverly; Beeson Skinner Beverly, LLP

(57) ABSTRACT

A system for assembling structural insulated panels (SIPs) includes a set of splines that snugly insert into channels along the top, bottom and side edges of each SIP. Vertical alignment splines are used to align and connect adjacent SIPs and horizontal plate splines are used to cap edge channels of a SIP such that the edges of the SIP can securely rest on, support or be affixed to a foundation or other structural member. The system components facilitate fast and precise alignment, interconnection and installation of SIPs in order to form walls, floors, roofs or foundation systems.

15 Claims, 23 Drawing Sheets

(56) References Cited

U.S. PATENT DOCUMENTS 2,394,443 A * 2/1946 Guignon, Jr. ..... E04B 1/617 52/580
2,863,185 A * 12/1958 Riedi ..... F16B 5/0076 403/297
3,563,582 A * 2/1971 Shroyer ..... E04B 1/6154 52/309.13
3,583,118 A * 6/1971 Lowery ..... E04B 1/6175 52/309.5
3,640,039 A * 2/1972 McKee ..... E04B 1/6158 52/281
3,641,730 A * 2/1972 Meckstroth ..... E04B 1/6133 52/586.2
3,660,952 A * 5/1972 Wilson ..... E04B 1/10 52/81.4
3,680,277 A * 8/1972 Martin ..... E04B 1/6154 52/438
3,686,817 A * 8/1972 Adams ..... E04B 1/6154 52/586.2
3,766,696 A * 10/1973 Totoonchie ..... E04B 1/6162 52/241
3,866,370 A * 2/1975 Guarino ..... E04B 2/7403 52/241
3,922,830 A * 12/1975 Guarino ..... E04B 2/7403 52/794.1
4,067,165 A * 1/1978 Timmons ..... E04B 2/7425 52/238.1
4,443,988 A * 4/1984 Coutu, Sr. ..... E04B 1/80 52/309.2
4,532,747 A * 8/1985 Koetje ..... B63B 3/18 29/507
4,545,168 A * 10/1985 Dalton, Jr. ..... E04B 1/6108 52/239
4,652,170 A * 3/1987 Lew ..... E04B 1/617 403/381
4,712,942 A * 12/1987 Brown ..... F16B 5/00 403/174
4,716,692 A * 1/1988 Harper ..... E04B 2/7425 52/239
4,982,535 A * 1/1991 Pickett ..... E01F 8/0023 256/16
5,014,476 A * 5/1991 Leslie ..... E04B 1/6162 52/220.2
5,062,250 A 11/1991 Buzzella
5,097,643 A * 3/1992 Wittler ..... E04B 2/7425 160/135
5,165,212 A * 11/1992 Arnold ..... E04B 2/707 52/265
5,172,532 A * 12/1992 Gibbar, Jr. ..... E04B 2/8652 52/309.12
5,179,810 A * 1/1993 Gename ..... E04B 2/7409 160/135
5,216,861 A * 6/1993 Meyerson ..... E04B 1/617 29/897.35
5,348,778 A * 9/1994 Knipp ..... B32B 3/06 312/400
5,368,416 A * 11/1994 Cataldo ..... E01F 8/0011 405/258.1
5,424,118 A * 6/1995 McLaughlin ..... E04B 1/6183 428/314.8
5,577,356 A * 11/1996 Hubbard ..... E04B 2/702 52/233
5,617,686 A 4/1997 Gallagher, Jr.
5,628,158 A * 5/1997 Porter ..... E04C 2/296 52/309.9
5,649,401 A 7/1997 Harrington, Jr.
5,651,220 A * 7/1997 dit Felix ..... E04B 1/3211 52/285.3
5,664,386 A * 9/1997 Palmersten ..... E04B 1/6129 52/586.1
5,701,708 A * 12/1997 Taraba ..... E04B 1/14 52/210
5,881,515 A * 3/1999 George ..... A63H 33/044 403/294
5,950,389 A 9/1999 Porter
6,029,831 A * 2/2000 Miller ..... E04B 2/7425 211/182
6,050,033 A * 4/2000 Wrightman ..... E04B 1/26 403/13
6,058,671 A * 5/2000 Strickland ..... E04B 1/6137 411/539
6,112,485 A * 9/2000 Beyer ..... E04B 2/7437 52/239
6,119,427 A * 9/2000 Wyman ..... E04B 1/12 52/127.11
6,186,691 B1 * 2/2001 Rudolf-Bauer ..... E04B 1/6813 403/31
6,272,802 B1 * 8/2001 Berberich ..... E04B 2/708 52/233
6,279,287 B1 * 8/2001 Meadows ..... E04C 2/292 52/309.9
6,308,491 B1 10/2001 Porter
6,338,231 B1 * 1/2002 Enriquez ..... E04B 1/04 52/258
6,481,172 B1 * 11/2002 Porter ..... B32B 5/18 52/506.01
6,799,404 B2 * 10/2004 Spransy ..... E04B 9/02 160/87
8,074,418 B2 * 12/2011 Thiagarajan ..... E04C 2/543 403/290
8,147,162 B1 * 4/2012 Burnett ..... F16B 5/0052 312/263
8,151,539 B2 * 4/2012 Grinsted ..... E04C 2/205 52/220.2
8,286,399 B2 * 10/2012 Brown ..... E04B 1/14 52/404.4
8,322,104 B2 * 12/2012 Fleming, III ..... B32B 3/06 160/87
8,371,080 B2 * 2/2013 Wrightman ..... E04B 2/705 52/233
8,615,963 B2 * 12/2013 Wrightman ..... F16B 5/0052 52/233
8,943,767 B2 * 2/2015 Lewis ..... E04D 13/0335 52/20
9,328,506 B2 * 5/2016 Gibson ..... E04B 1/76
9,650,785 B2 * 5/2017 Yu ..... E04C 2/521
10,246,873 B1 * 4/2019 Costanza ..... E04B 1/6141
10,487,495 B2 * 11/2019 Schilcher ..... E04B 1/6162
2002/0170259 A1 * 11/2002 Ferris ..... E01C 5/00 52/596
2004/0010991 A1 1/2004 Felser
2004/0134162 A1 7/2004 Douglas
2004/0177575 A1 * 9/2004 Posselt ..... E04B 2/702 52/282.1
2006/0230700 A1 * 10/2006 Chen ..... E04C 2/20 52/586.1
2006/0248825 A1 * 11/2006 Garringer ..... E04B 2/705 52/233
2007/0163197 A1 * 7/2007 Payne ..... E04B 1/14 52/586.1
2007/0175158 A1 * 8/2007 Cope ..... E04B 1/2604 52/585.1
2007/0251181 A1 * 11/2007 Dupont ..... E04F 13/0805 52/586.1
2007/0294967 A1 * 12/2007 Posselt ..... E04B 2/702 52/233
2009/0056251 A1 * 3/2009 Wrightman ..... E04B 2/705 52/233
2009/0100780 A1 * 4/2009 Mathis ..... E04B 1/14 52/578
2009/0193735 A1 * 8/2009 Kalinowski ..... E04B 2/60 52/281
2009/0199497 A1 * 8/2009 Wrightman ..... E04B 2/705 52/233
2009/0205277 A1 * 8/2009 Gibson ..... E04B 7/22 52/309.9
2009/0241460 A1 * 10/2009 Beaulieu ..... E04B 1/6129 52/586.2

(56) References Cited

U.S. PATENT DOCUMENTS

2010/0011699 A1* 1/2010 Weimer ..... E04B 2/7401 52/745.1
2010/0284751 A1* 11/2010 Price ..... E04C 1/395 405/284
2010/0325990 A1* 12/2010 Taraba ..... E04C 2/34 52/302.1
2011/0047922 A1* 3/2011 Fleming, III ..... B32B 3/06 52/582.1
2011/0173925 A1* 7/2011 Brown ..... E04B 1/14 52/794.1
2012/0198781 A1* 8/2012 Wrightman ..... E04B 2/705 52/233
2013/0227902 A1* 9/2013 Van Sloun ..... E04C 2/296 52/309.4
2013/0239507 A1* 9/2013 Fleming, III ..... B32B 21/08 52/582.1
2014/0208673 A1* 7/2014 Huang ..... E04B 2/7401 52/234
2014/0250827 A1 9/2014 Gillman
2016/0002913 A1* 1/2016 Schilcher ..... E04B 1/10 52/586.2
2016/0032585 A1* 2/2016 Park ..... E04C 1/00 52/592.6
2016/0053491 A1* 2/2016 Fleming, III ..... B32B 21/08 52/586.1
2016/0153191 A1* 6/2016 Henderson ..... E04C 2/46 52/220.2
2018/0298600 A1 10/2018 Moss

FOREIGN PATENT DOCUMENTS

DE 19745840 A1 4/1999
EP 0644337 A1 3/1995
GB 1448683 A 9/1976
GB 2451275 A 7/2007
WO 2010148460 A1 12/2010
WO 2011033289 A1 3/2011

OTHER PUBLICATIONS

SIP Dual Plywood Spline Joint. URL: https://www.greenbuildingadvisor.com/cad/detail/sip-dual-plywood-spline-joint; Date Accessed: Mar. 19, 2019.

* cited by examiner

SYSTEM AND METHOD FOR ASSEMBLING STRUCTURAL INSULATED PANELS

BACKGROUND

Field of the Invention

This invention relates to wall construction and, more particularly, relates to a system and method of assembling structural insulated panels (SIPs).

Discussion of the Prior Art

A structural insulated panel (SIP) is a building material consisting of an insulating layer of rigid core material sandwiched between two layers of structural board. SIPs can be used to construct walls, roofs, floors and foundation systems.

SIPs provide several benefits over conventional building framing materials. Although the cost of SIPs is typically higher than that of conventional building framing materials, a building using SIPs will generally have a tighter building envelope and superior insulating properties, leading to fewer drafts and reduced operating costs. In addition, SIPs generally come precut from the factory to conform to job specifications, such that the exterior building envelope can be built on-site quickly, reducing construction time and labor requirements. SIPs also tend to be lightweight and compact, reducing costs associated with the transportation of materials to the build site. As a result, the total life-cycle cost of a building constructed with SIPs can, in general, be lower than that of a conventionally framed building.

In addition, the environmental performance of SIPs is superior to conventionally framed construction due to superior thermal insulation, and SIPs address issues related to dampness and cold, such as compression shrinkage and cold bridging, more effectively than timber and other traditional building materials.

Prefabricated SIPs can, however, once transported to the building site, be difficult to align and securely interconnect to one another.

SUMMARY OF THE INVENTION

The present invention provides a system and method for fast and precise alignment, interconnection and installation of SIPs to form walls, floors, roofs or foundation systems. The system includes a set of splines that snugly insert into channels along the top, bottom and side edges of each SIP. Vertical alignment splines are used to align and interconnect adjacent SIPs and plate splines are used to cap edge channels of a SIP such that the edges of the SIP can securely rest on, support or be affixed to a foundation or other structural member. The system does not require the use of traditional fasteners, such as screws or nails, providing a further improvement over conventional building framing materials.

BRIEF DESCRIPTION OF THE DRAWINGS

Exemplary embodiments of the invention will now be described with reference to the accompanying drawings, in which.

DETAILED DESCRIPTION OF THE ILLUSTRATED EMBODIMENTS

Figure 1:
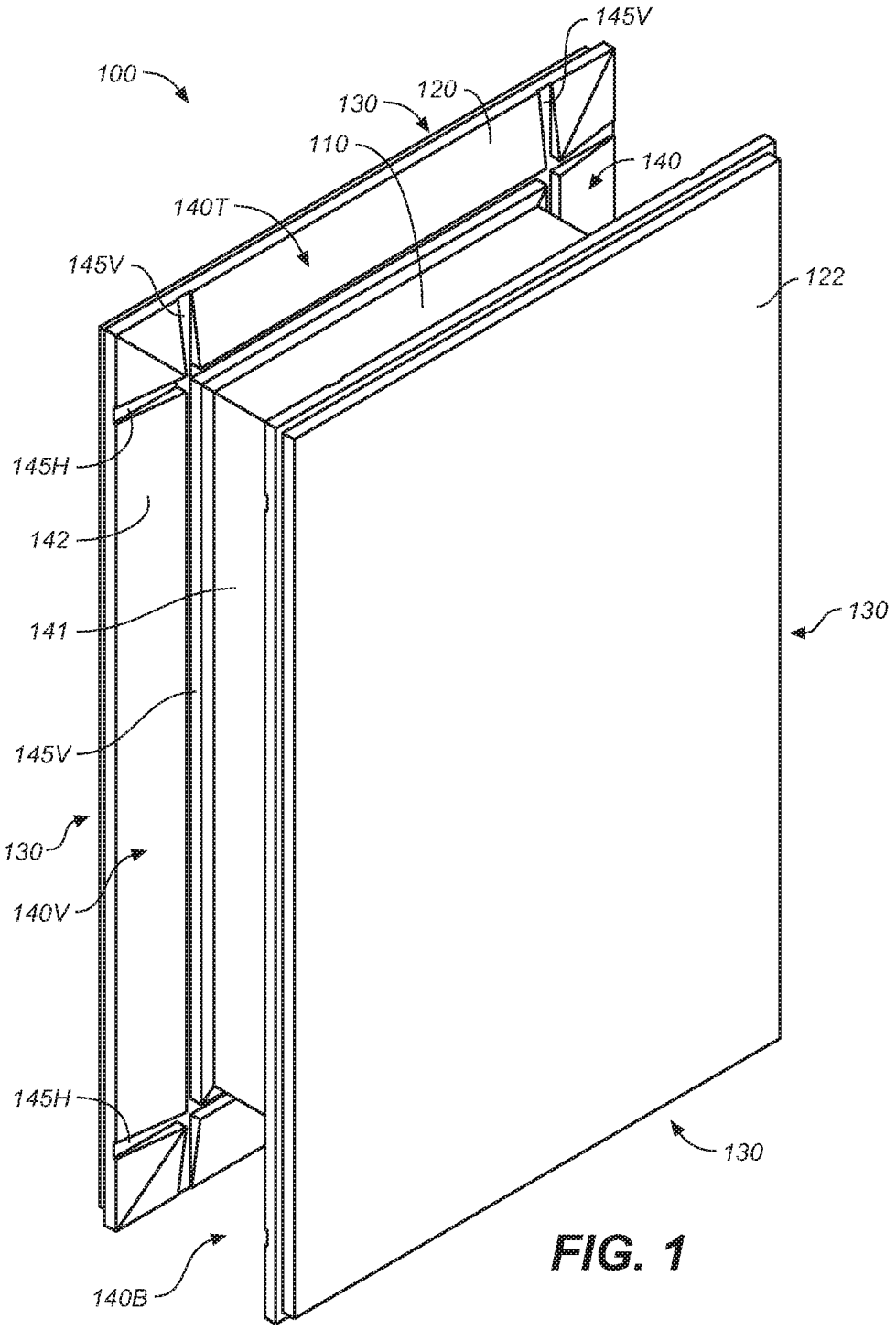
FIG. 1 shows a structural insulated panel (SIP) having edge channels according to the invention.

Referring to the drawings, FIG. 1 shows an embodiment of a SIP (100) having edge channels according to the invention. The SIP is made of a rigid core (110) of insulating material sandwiched between two layers of structural board (120, 122). The board layers (120, 122) can be made of magnesium oxide board (MgO), oriented strand board (OSB), sheet metal, plywood, cement or another suitable board material. The core (110) can be made of expanded polystyrene foam (EPS), extruded polystyrene foam (XPS), polyisocyanurate foam, polyurethane foam, composite honeycomb (HSC) or another suitable rigid core material.

Along the four edges 130 of the SIP, between the two layers of structural board, are top, bottom and vertical side edge channels (140T, 140B, 140V), each having an inner face (141) and two opposing tapered surfaces (142) extending between the inner face and one of the edges. An alignment spline (FIG. 2, 200) can be inserted into any of the vertical edge channels (140V) and a plate spline (FIG. 3, 300) can be inserted into the top or bottom edge channels (140T, 140B). Vertical edge channel key slots (145V) are disposed along and extend inwardly into the tapered surfaces (142) of the side edge channels (140V) as shown and align with alignment spline key slots (245) on an alignment spline (200) that is received in one of the side edge channels. Similarly, horizontal edge channel key slots (145H) disposed along and extending inwardly into the tapered surfaces (142) of top or bottom edge channels (140T, 140B) align with plate spline keys slots (FIG. 3, 345) provided on a plate spline (300) that is received in either of the top or bottom edge channels. Together, each pair of aligned key slots is cooperatively configured to form a locking channel to receive a locking pin (FIG. 4, 400) for securely locking the inserted alignment spline (200) or a plate spline (300) in place in one of the edge channels of the SIP (100).

Figure 2:
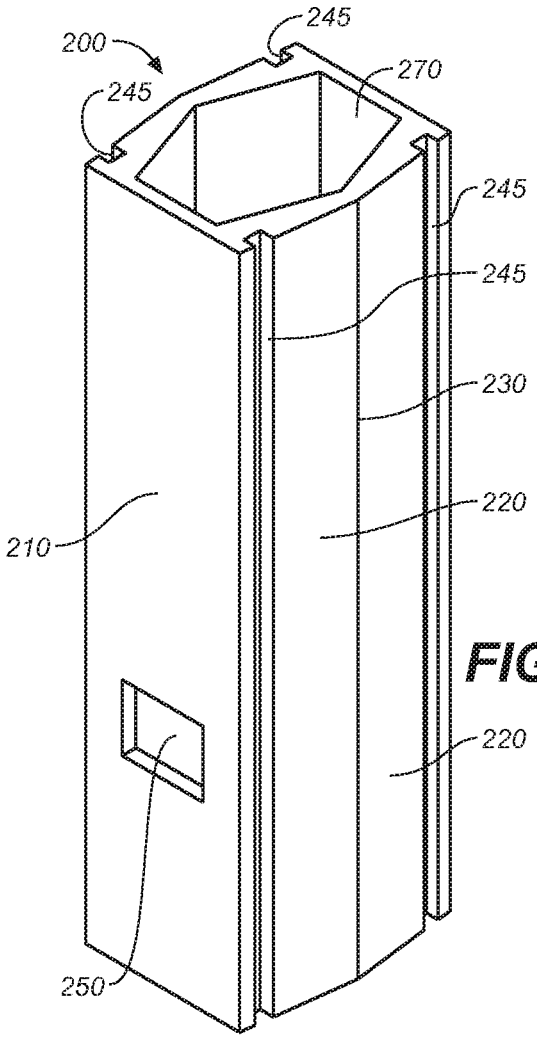
FIG. 2 shows an alignment spline according to the invention.

As seen in FIG. 2, an alignment spline (200) forms a hexagonal cross-section, the opposing, symmetrical halves of which each conform to the shape of the edge channels (140) of the SIP (100), and which has a hollow core (270). The alignment spline can suitably have a differently shaped cross-section but should have mirror symmetry of a shape closely conforming to that of the edge channels of the SIP (100). The alignment spline allows two SIPs having standardized edge channels to be securely interconnected. The illustrated alignment spline shows each half having an end face (210) and two oppositely facing tapered faces (220) extending from the middle (230) of the spline to the end face (210). Each alignment spline has four outwardly facing alignment spline key slots (245), one extending into each of the tapered faces (220), that align with the vertical keyslots (145V) on side edge channels (140V) to form locking channels (145V/140V) for receiving locking pins (400). An opening (250) on the side of the alignment spline provides access to a hold-down block (see FIGS. 5A and 5B), which may be received in the hollow core (270) of the alignment spline for securing the alignment spline to a foundation member, as discussed below with respect to FIGS. 9A and 11.

Figure 3:
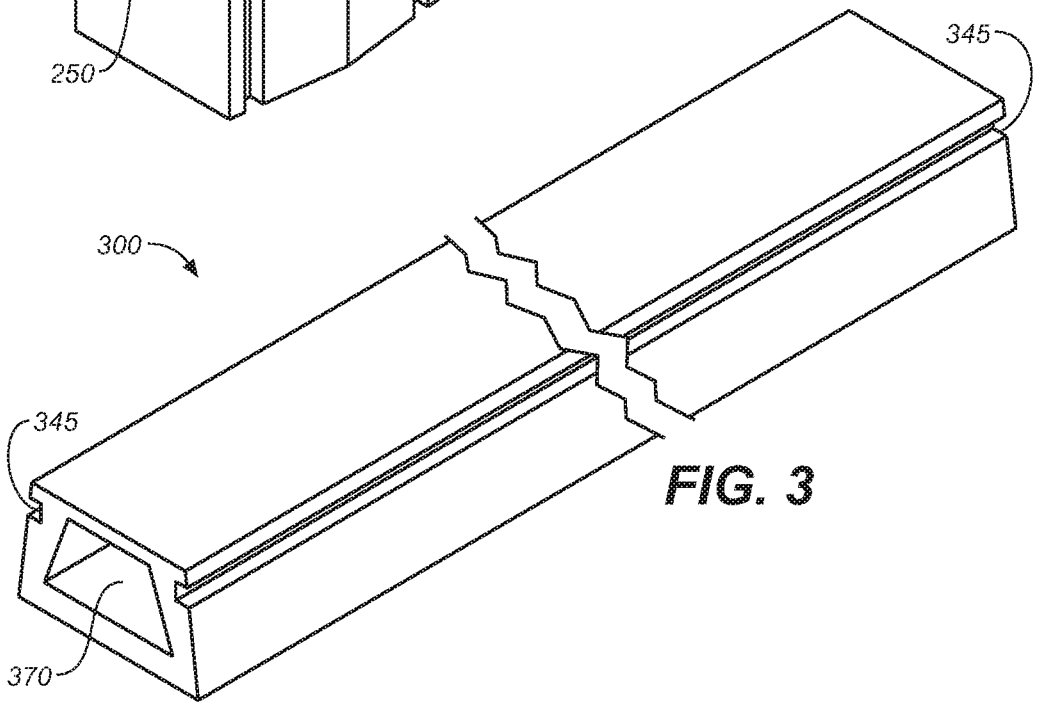
FIG. 3 shows a plate spline according to the invention.

Referring next to FIG. 3, it can be seen that a plate spline (300) is effectively half of an alignment spline (200), or an alignment spline divided along a longitudinal plane. In the illustrated embodiment, the plate spline has a trapezoidal cross-section that closely conforms to the shape of the top and bottom edge channels (140T, 140B) of the SIP (100). The plate spline can be snugly inserted into one of the top or bottom edge channels of the SIP (100) to form a flat edge surface which can securely rest on or against, support or be affixed to a foundation or other anchoring member, as further discussed below with respect to FIGS. 7A to 7D. The illustrated plate spline (300) has two plate spline key slots (345) that align with horizontal key slots (145H) in the to or bottom edge channels (140T, 140B) of the SIP (100) to cooperatively form two locking channels (145H/345) for receiving locking pins (400). The hollow cores (270, 370) of both the alignment spline (200) and plate spline (300) can house electrical wiring or plumbing components.

Figure 4:
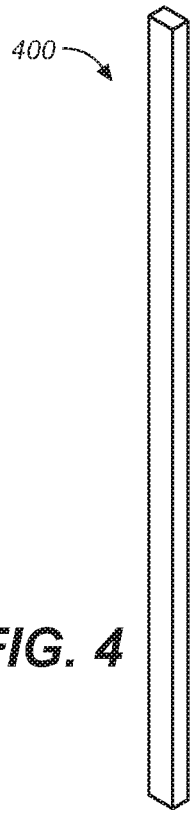
FIG. 4 shows a locking pin according to the invention.

One embodiment of a locking pin (400), as seen in FIG. 4, is configured to be inserted into a locking channel for securing either an alignment spline or plate spline to an edge channel of the SIP (100). An inserted locking pin (400) prevents outward movement or shifting of the inserted alignment spline (200) or plate spline (300) within the edge channel (140H, 140V). The key slots of the edge channels (140H, 140V), alignment spline (200) or plate spline (300) may be tapered from a wider width at their opening insert ends to a narrower width at their midpoints to facilitate insertion of the locking pin and to aid in the snug fitting of the alignment spline or plate spline within the edge channel.

The edge channels (140) of the SIP, alignment spline (200), plate spline (300) and locking pin (400), can all suitably be made of fiber reinforced plastic (i.e., fiberglass), which provides exceptional strength, as well as resistance to moisture buildup, mold and termites. Fiberglass is an exceptional material for use in buildings located in hurricane and flood prone areas. It should be understood, however, that the edge channels, splines and locking pins can be manufactured from other strong, high-performance materials.

Figure 5A:
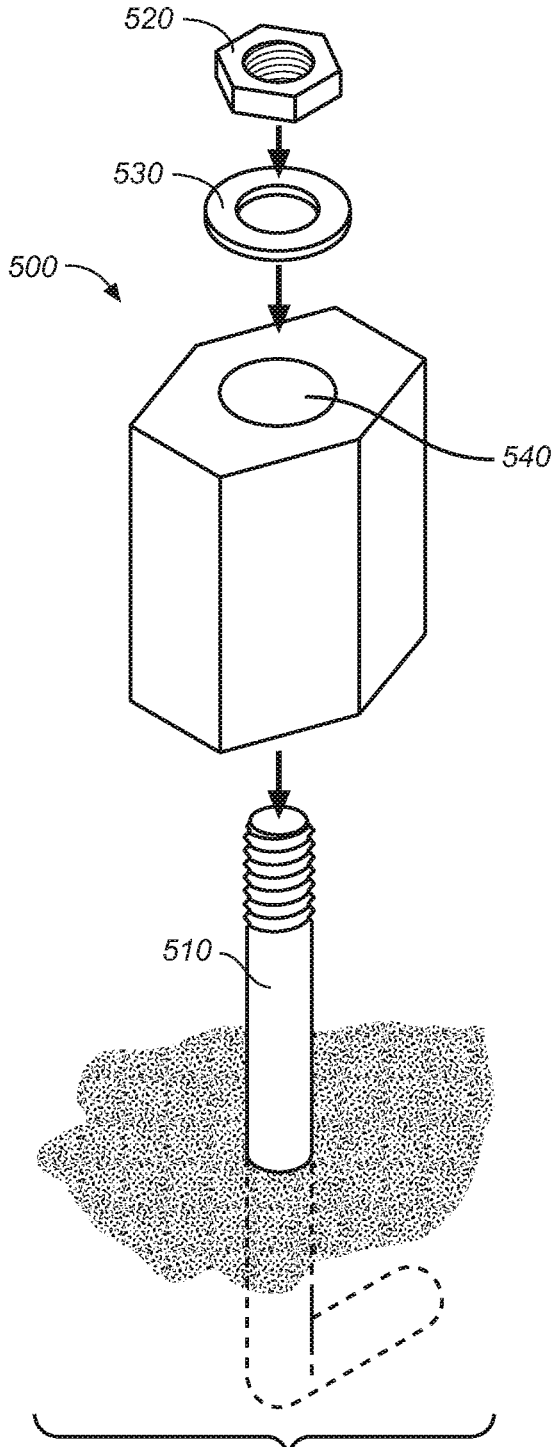
FIGS. 5A and 5B show a hold-down block according to the invention.
Figure 5B:
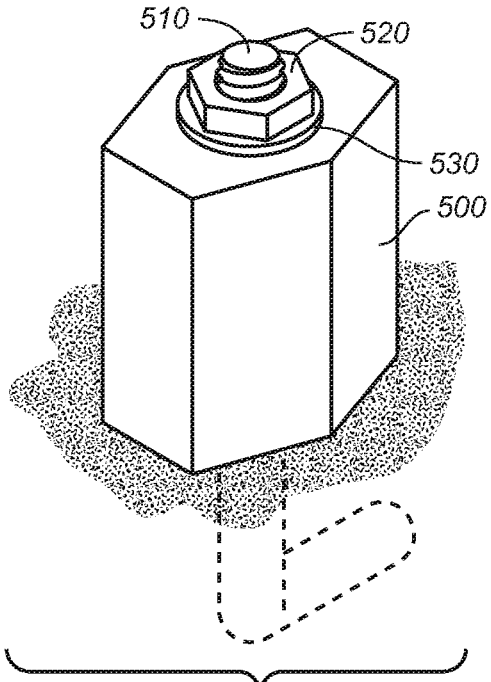

With reference now to FIGS. 5A and 5B, a hold-down block (500) may be used in the formation of walls constructed using one or more SIPs (100), for securing a wall formation to a foundation. The hold-down block is anchored to the foundation using a suitable anchor bolt, such as the illustrated J-bolt (510), installed in a concrete foundation wall. The hollow core (540) of the hold-down block is sized large enough to loosely receive the anchor bolt (510) and such that an exact fit of the anchor bolt (510) within the hollow core (540) is not required. This provides some margin of error for the alignment of the hold-down block and anchor bolt components during installation.

With additional reference to FIGS. 9A-11, an alignment spline (200A) may be placed over the hold-down block (500) to secure the alignment spline in place. The top of the hold-down block may be tapered to facilitate receipt of the hold-down block (500) into the hollow core of the alignment spline (200A). Once the alignment spline is placed over the anchor bolt, a nut (520) and washer (530) can be accessed through the opening (250) on the side of the alignment spline (200*a*) to securely fasten the hold-down block with the anchor bolt to the foundation member (FIG. 5B).

Figure 6:
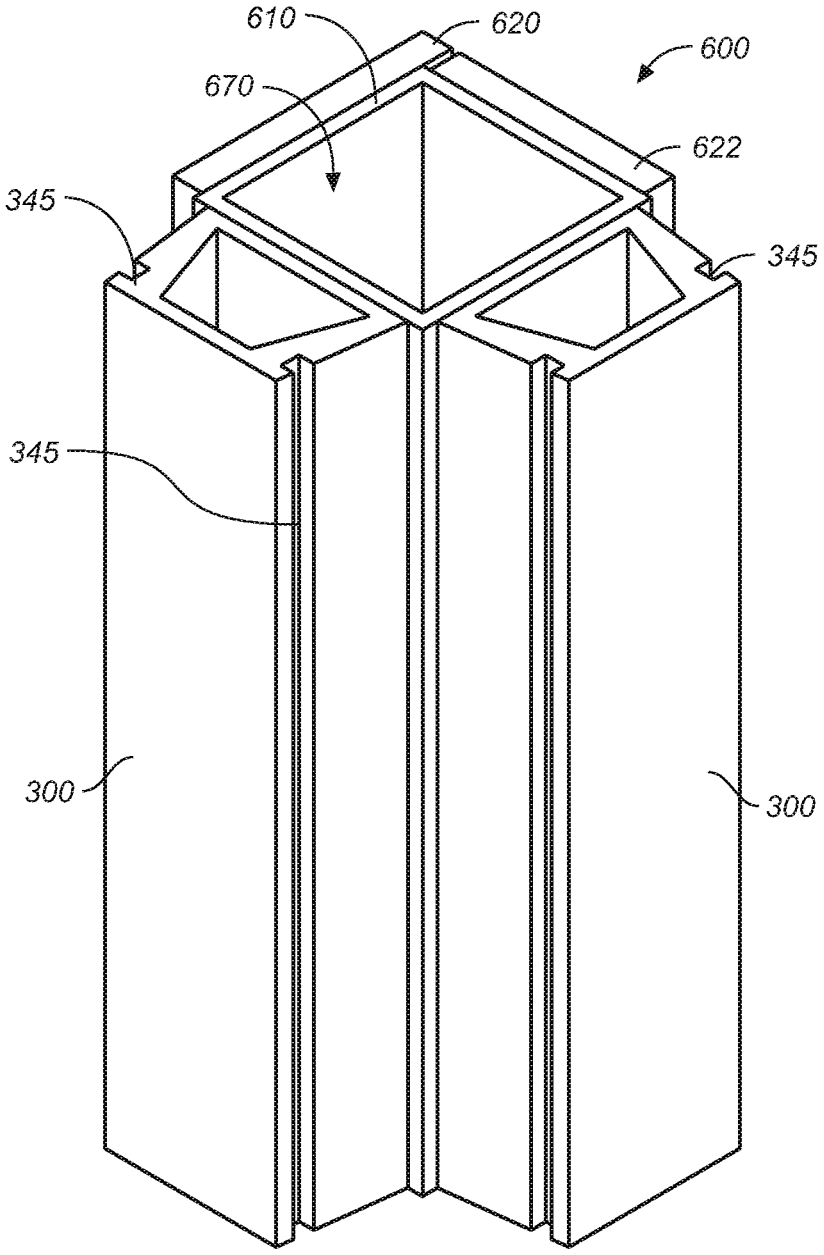
FIG. 6 shows a corner assembly according to the invention.

Referring next to FIG. 6, a corner assembly (600) comprises a corner column (610) with structural board (620, 622) affixed to two of its faces and plate splines (300*a*, 300*b*) affixed to its other two faces. The corner column (610) is a hollow, rectangular extrusion of fiberglass or other strong material. As discussed in greater detail below with respect to FIGS. 12A to 13, the corner assembly (600) is used to construct a corner. Like the alignment spline and plate spline components, the corner assembly has a hollow core (670) that can house electrical wiring or plumbing components.

Figure 7A:
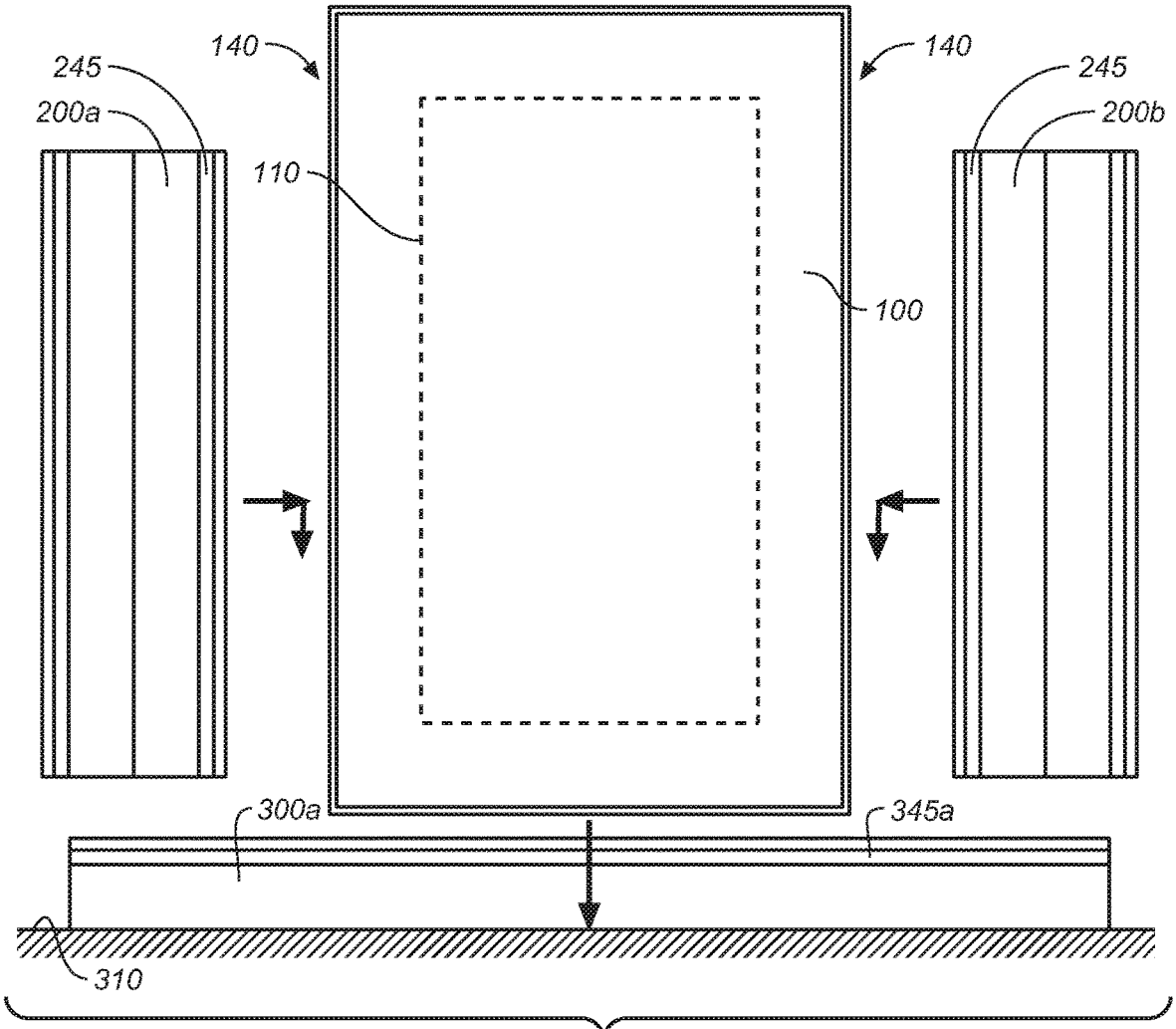
FIGS. 7A to 7D illustrate a method of fitting and securing alignment splines and plate splines to the edge channels of a SIP according to the invention.

A method of fitting alignment splines (200*a*, 200*b*) and plate splines (300*a*, 300*b*) to the edge channels of a SIP (100) is now discussed with respect to FIGS. 7A-7D. In FIG. 7A, a bottom plate spline (300*a*) is affixed to a foundation member (310) and a SIP (100) is set on the foundation member with the bottom plate spine (300*a*) snugly received in the bottom edge channel (140B) of the SIP (100) (see FIG. 7B). Key slots (345*a*) in the bottom plate spline (300*a*) align with the horizontal key slots (145H) in the bottom edge channel (140B) of the SIP (100) forming locking channels (145H/345*a*).

Alignment splines (200*a*, 200*b*) are inserted into the vertical edge channels (140V) of the SIP (100). Key slots (245*a*, 245*b*) in the alignment splines (200*a*, 200*b*) align with vertical key slots (145V) in the vertical edge channels (140V) of the SIP (100) forming locking channels (145V/245).

Figure 7B:
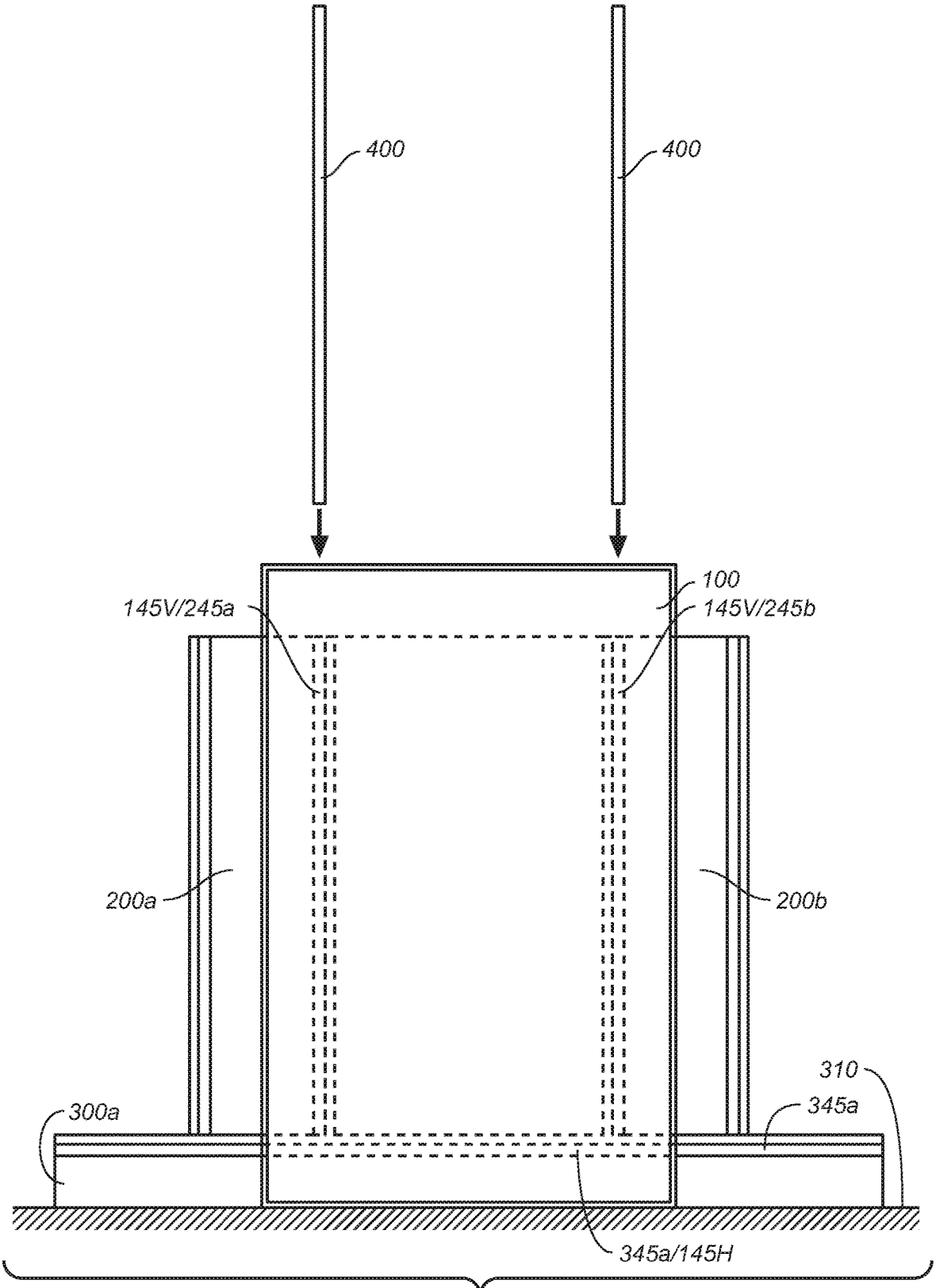
Figure 7C:
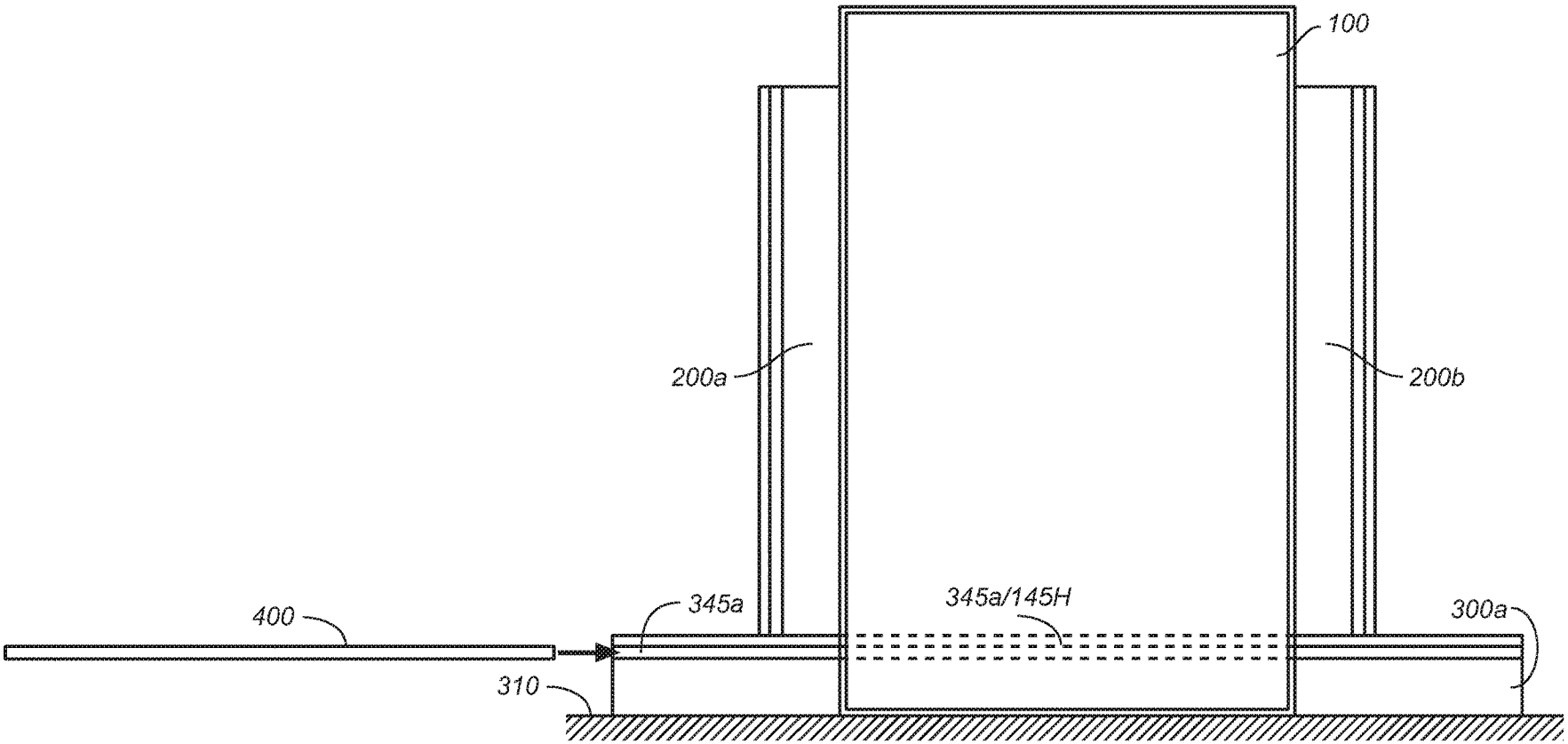

As seen in FIG. 7B, locking pins (400) are inserted into the resulting locking channels (145V/245) of the alignment splines (200*a*, 200*b*) and vertical edge channels (140V) for securing the alignment splines (200*a*, 200*b*) to the SIP (100). As seen in FIG. 7C, locking pins (400) are inserted into the locking channels (145H/345*a*) of the bottom plate spline (300*a*) and the bottom edge channel (140B) of the SIP (100) for securing the bottom plate spline (300*a*) to the SIP (100).

Figure 7D:
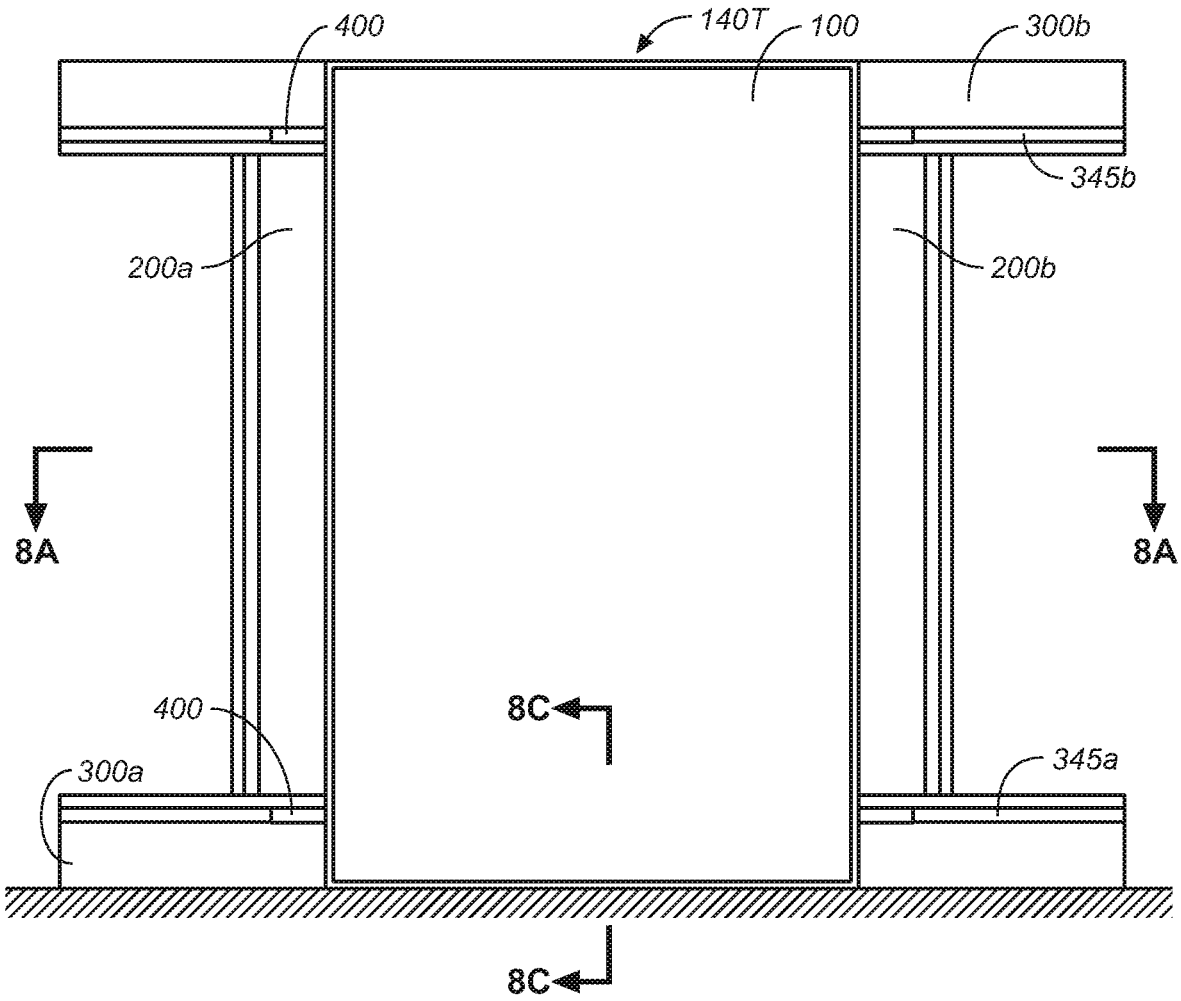

As shown in FIG. 7D, a top plate spline (300*b*) is inserted into the top edge channel (140T) of the SIP (100), with the key slots (345*b*) of the top plate spline (300*b*) aligning with the horizontal key slots (145H) of the top edge channel (1401) of the SIP (100). The top plate spline (300*b*) is locked into the top edge channel (140T) with locking pins (400).

Figure 8A:
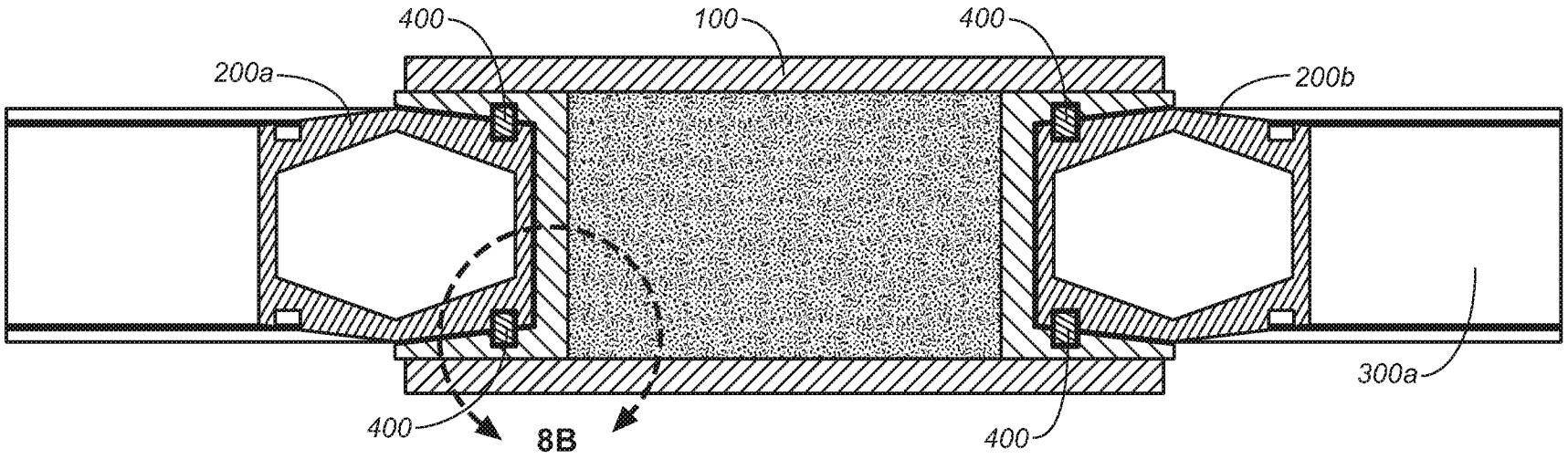
FIG. 8A shows a cross-sectional view, taken along line 8A-8A of FIG. 7D, of a SIP fitted with alignment splines and plate splines according to the invention.
Figure 8B:
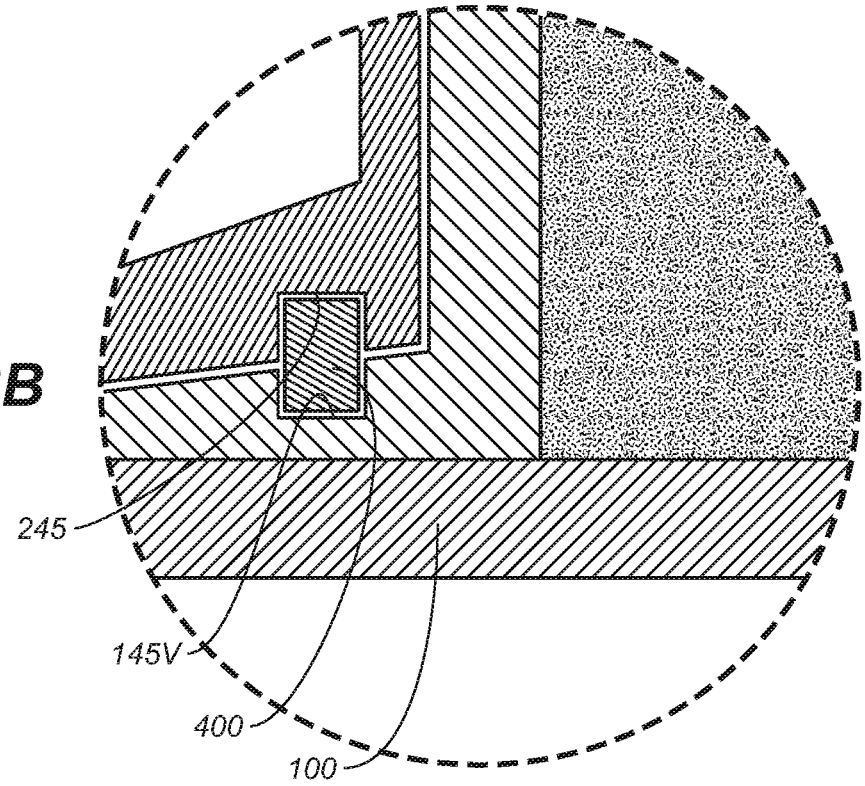
FIG. 8B shows a detailed view, taken along line 8B of FIG. 8A, of an alignment spline secured to a SIP with a locking pin according to the invention.

As shown in FIGS. 8A-8B, the alignment splines (200*a*, 200*b*) are snugly received in the vertical edge channels (140V) of the SIP (100) and the locking pins (400) are snugly received in the locking channels (145V/245). The tight fit of the inserted locking pins (400) within the locking channels (145V/245) prevents outward movement or shifting of the alignment splines (200*a*, 200*b*), thus securing the alignment splines (200*a*, 200*b*) within the vertical edge channels of the SIP (100).

Figure 8C:
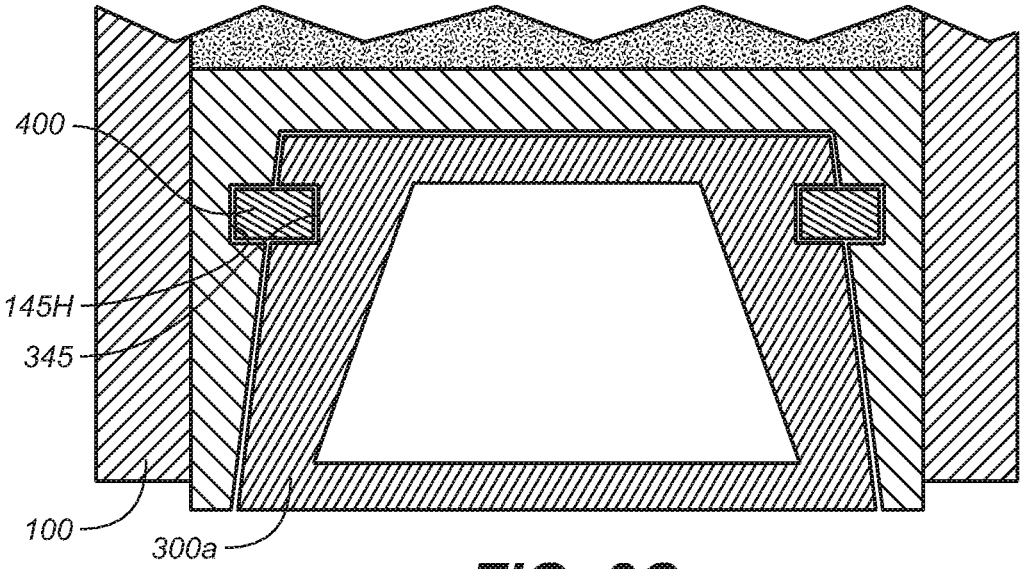
FIG. 8C shows a cross-sectional view, taken along line 8C-8C of FIG. 7D, of a plate spline inserted into the bottom channel of a SIP and secured with a locking pin according to the invention.

In FIG. 8C, the bottom plate spline (300*a*) is shown snugly received in the bottom edge channel (140B) of the SIP (100) and two locking pins (400) are snugly received in the horizontal locking channels (145H/345). The tight fit of the inserted locking pins (400) prevents movement or shifting of the SIP (100) on the bottom plate spline (300*a*). The top plate spline (300*b*) is securely locked into the top edge channel (140T) of the SIP (100) in similar fashion (see FIG. 7D).

Figure 9A:
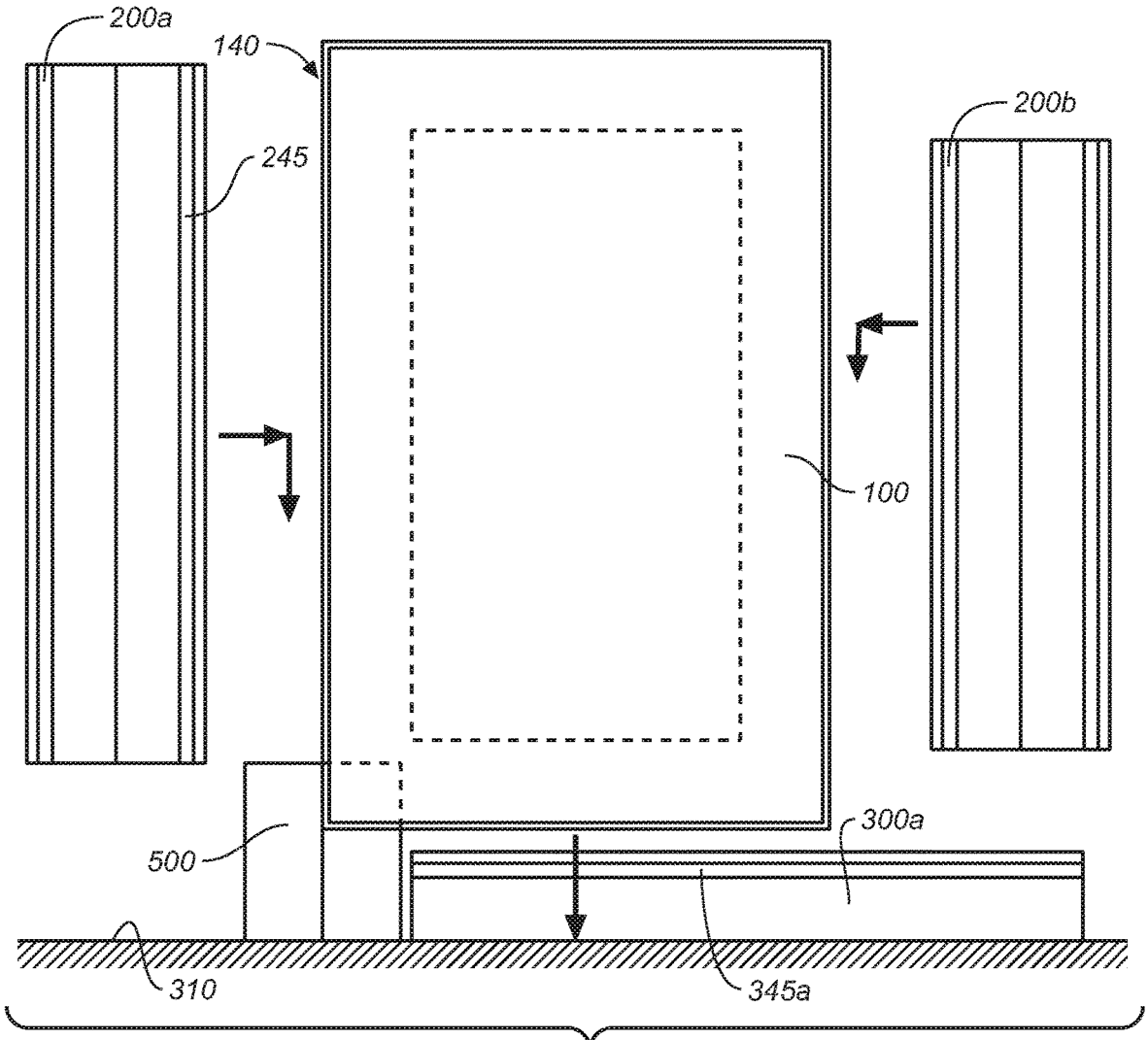
FIGS. 9A to 9C illustrate a method of assembling a wall using the system of the invention.
Figure 11:
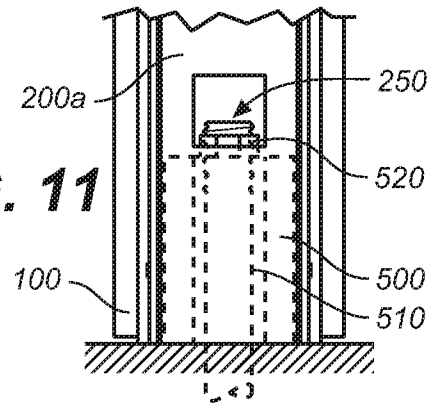
FIG. 11 shows a side elevation view, taken along line 11-11 of FIG. 9C, of a portion of a wall assembled using the system of the invention.

A method of fitting alignment splines and plate splines to the edge channels of a SIP to form a wall, and to secure the wall to a foundation using a hold-down block (500), is now discussed with reference to FIGS. 9A-9C. In FIG. 9A, a hold-down block (500) is secured to a foundation member (310) with an anchor bolt. A first alignment spline (200*a*) is inserted into a vertical edge channel (140V) of the SIP (100) and slid over the hold-down block (500). As shown in FIG. 11, the opening (250) on the side of the first alignment spline (200*a*) provides access to the nut (520) and washer (530) used to secure the hold-down block (500) to anchor bolt (510). In another embodiment, not illustrated, locking pins or other fasteners may be used to secure the first alignment spline (200*a*) to the hold-down block (500). A second alignment spline (200*b*) is inserted into the other vertical edge channel (140V) of the SIP (100) and locking pins (400) are used to secure both alignment splines (200*a*, 200*b*) to the SIP (100).

Figure 9B:
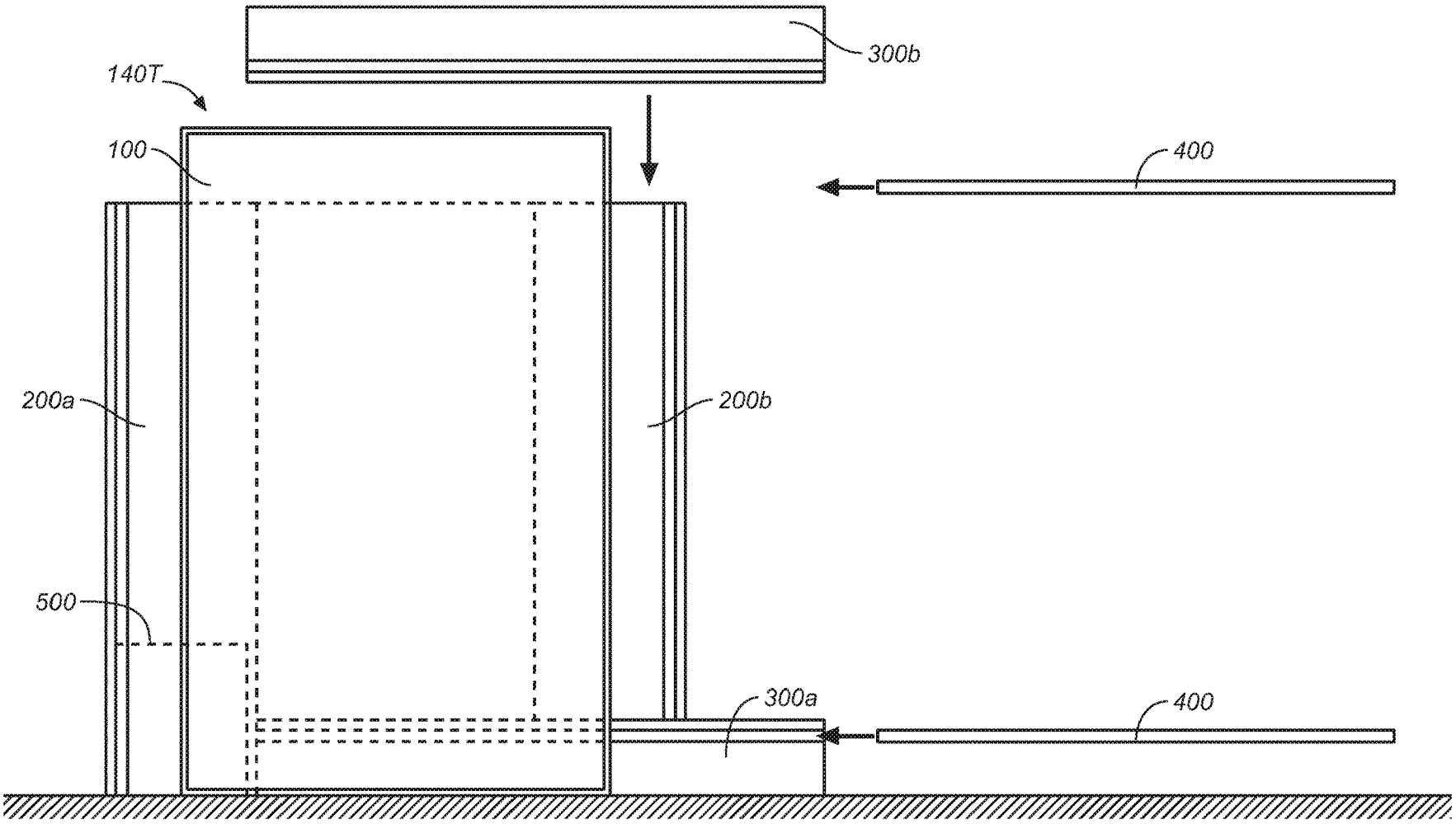
Figure 9C:
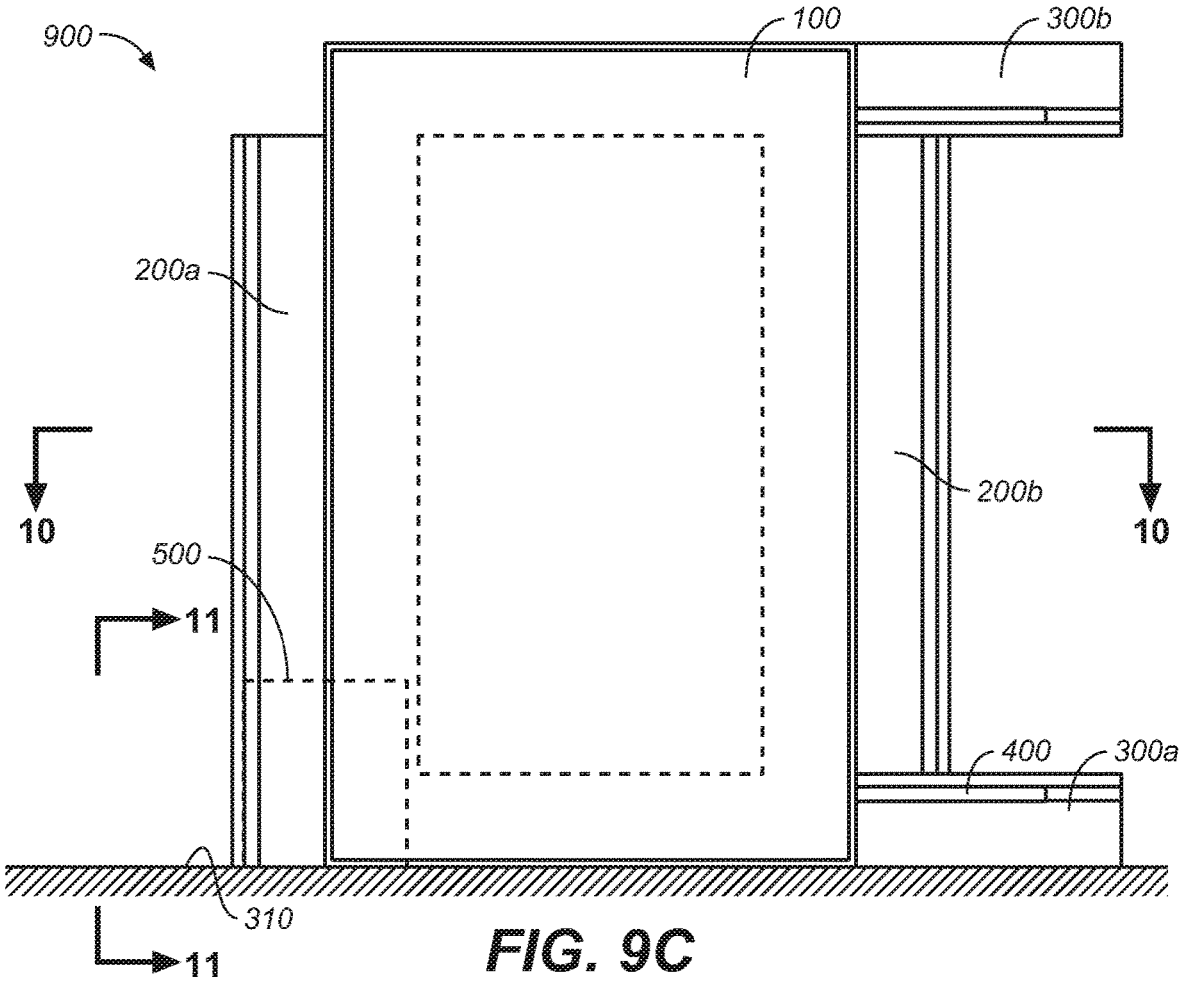

In FIGS. 9B-9C, a top plate spline (300*b*) is inserted into the top edge channel (140T) of the SIP and locking pins (400) are inserted into the locking channels formed by the aligned key slots of the plate splines (300*a*, 300*b*) and the horizontal edge channels (140V) of the SIP (100), securing both plate splines (300*a*, 300*b*) to the SIP (100).

Figure 10:
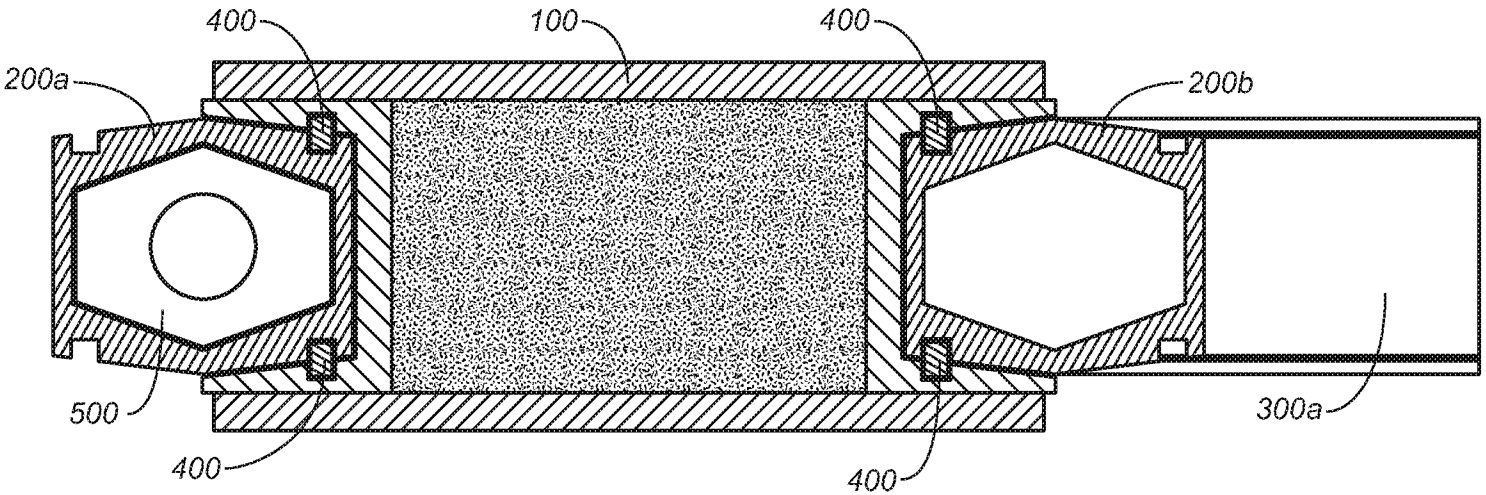
FIG. 10 shows a cross-sectional view, taken along line 10-10 of FIG. 9C, of a portion of a wall assembled using the system of the invention.

FIG. 10 shows a detailed view of the interconnected SIP (100), alignment splines (200*a*, 200*b*), hold-down block (500) and plate spline (300*a*).

Figure 12A:
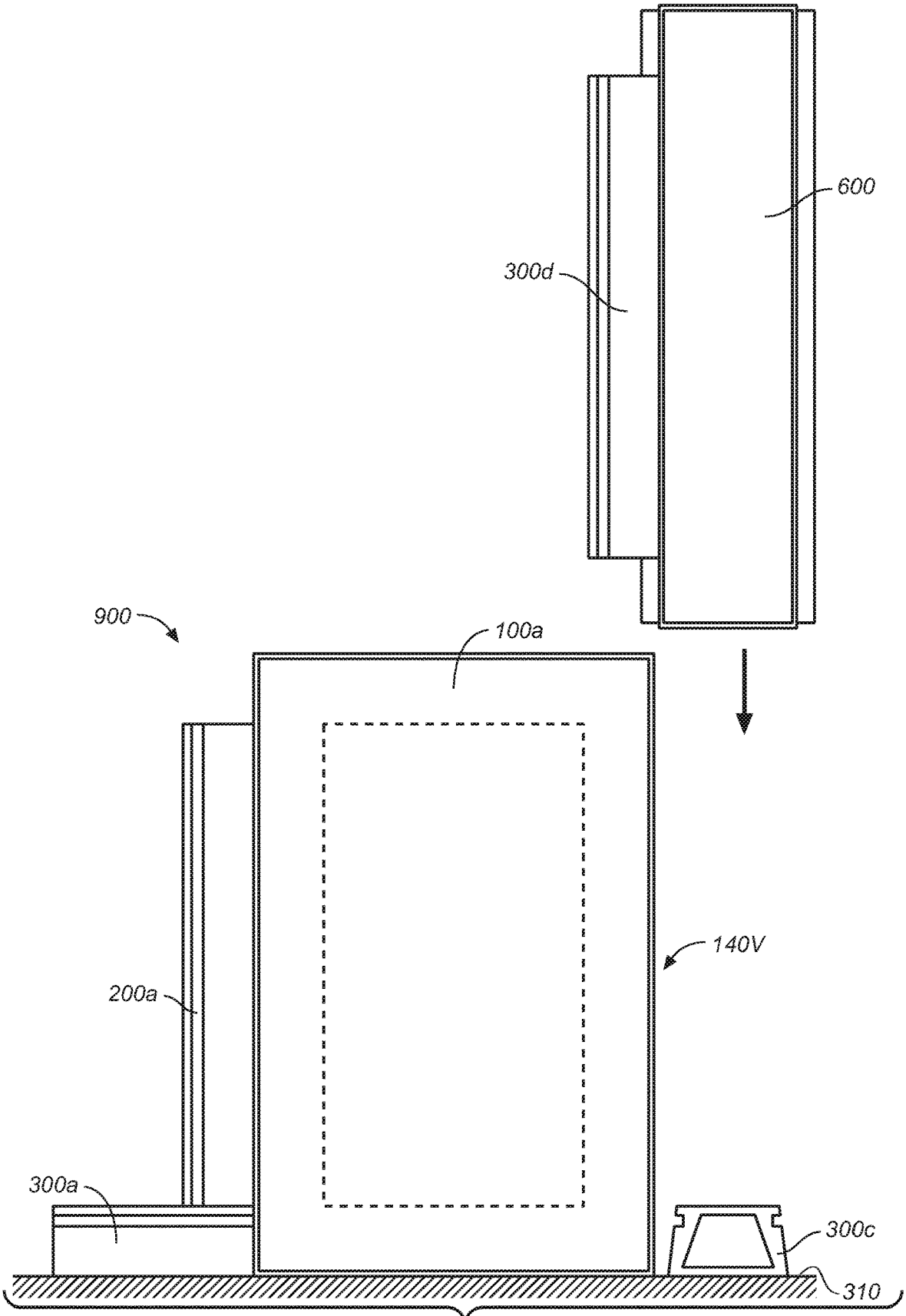
FIGS. 12A to 12D illustrate a method of assembling a corner using the system of the invention.
Figure 12B:
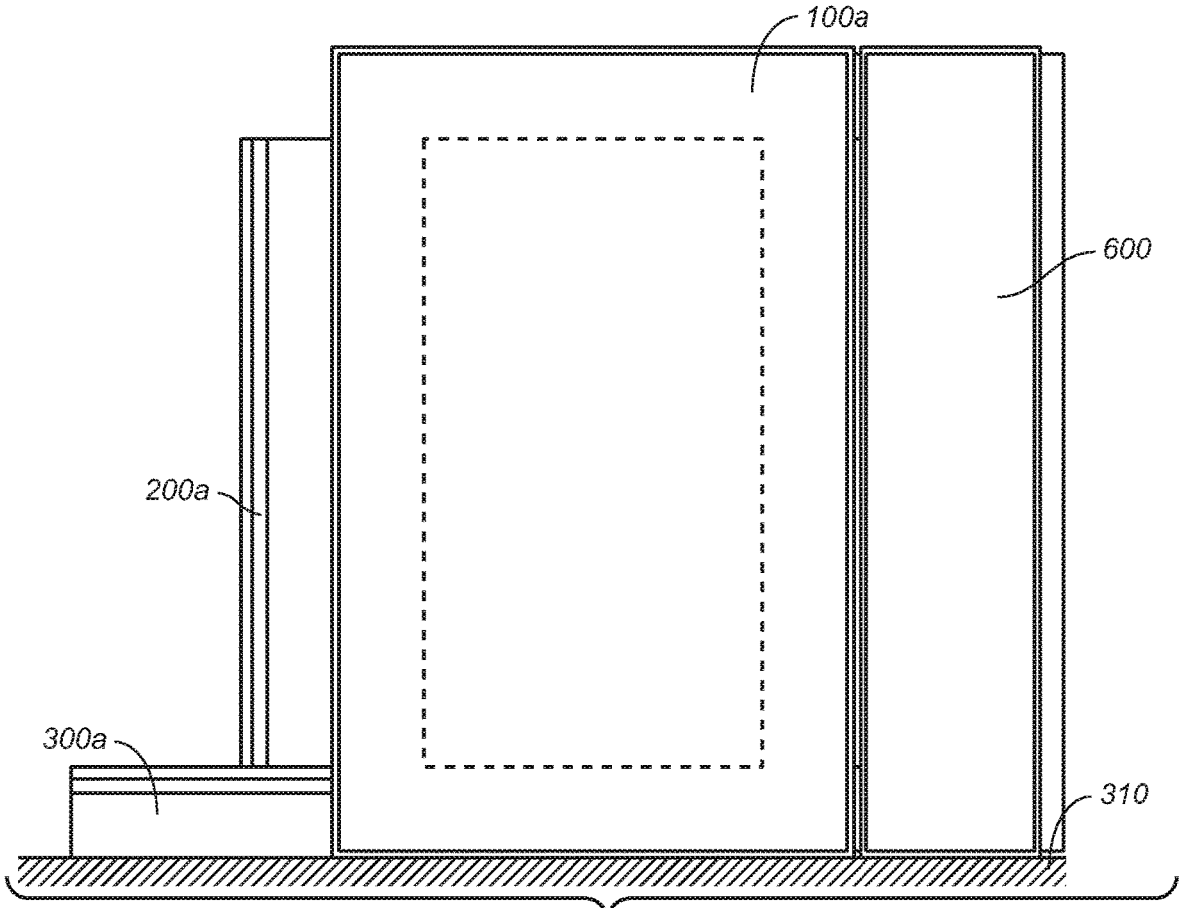
Figure 12C:
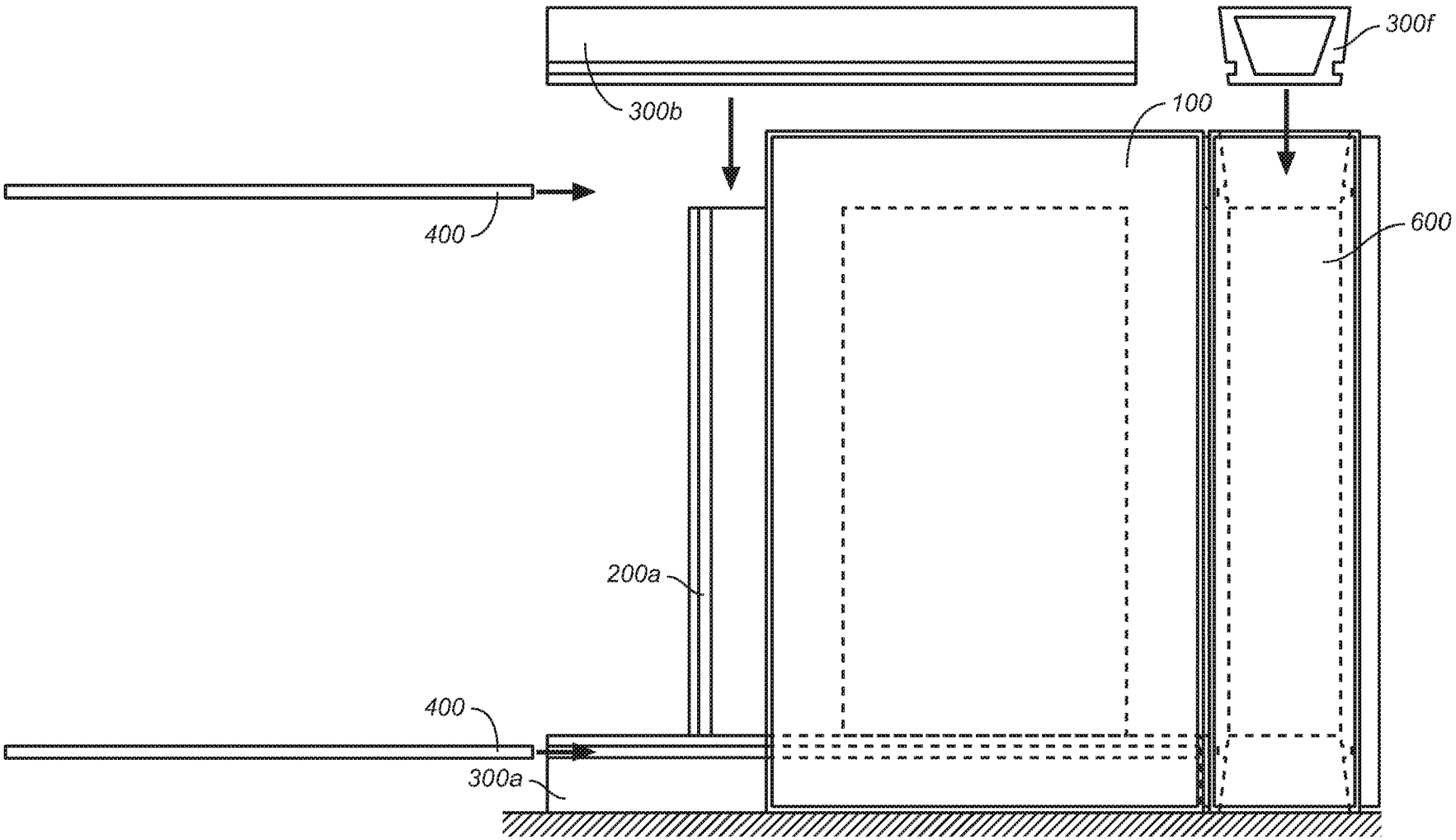
Figure 12D:
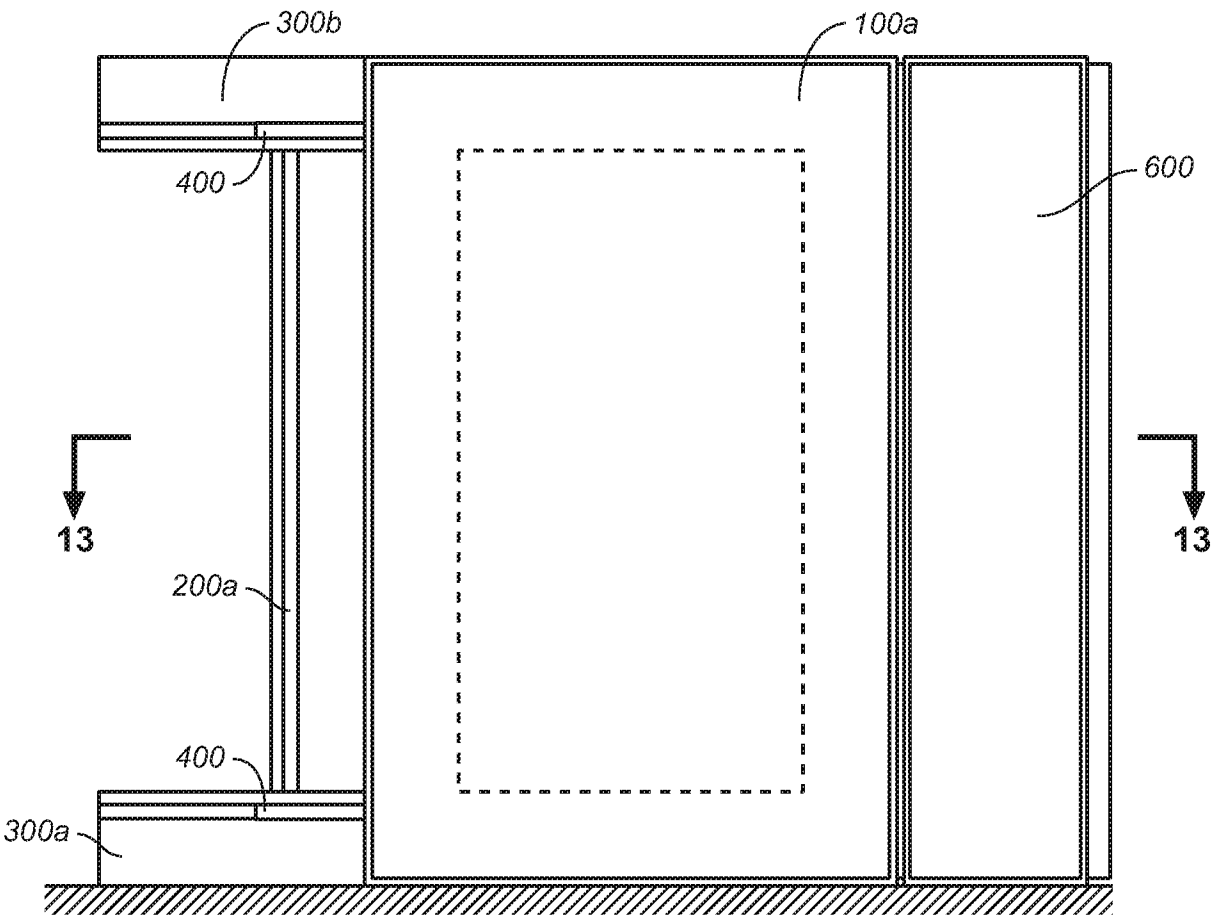
Figure 13:
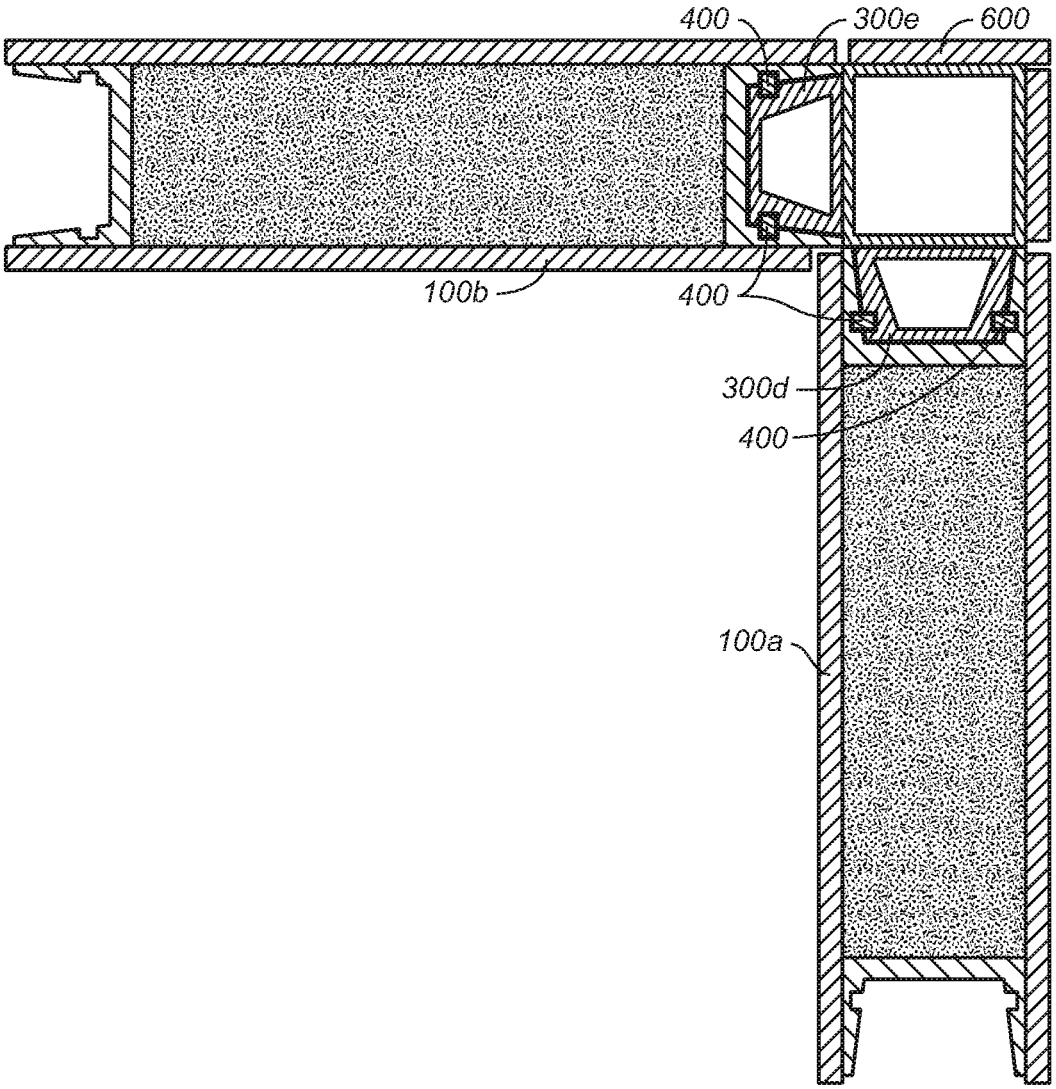
FIG. 13 shows a top plan view of a portion of a corner assembled using the system of the invention.

A method of assembling a corner with two SIPS (100*a*, 100*b*) according to the invention is now described with respect to FIGS. 12A-13. As seen in FIG. 12A, with the first SIP (100*a*) set into place, another bottom plate spline (300*c*) is affixed to the foundation member (310), perpendicular to the SIP (100*a*). A corner assembly (600) is then lowered over the affixed bottom plate spline (300*c*) and one of the corner assembly plate splines (300*d*) is received in the open vertical edge channel (140V) of the SIP (100*a*), securing the corner assembly (600) to the foundation (310) and the first SIP (100*a*), as shown in FIG. 12B. The second SIP (100*b*) is then secured to the corner assembly (600) by receiving the other corner assembly plate spline (300*e*) in a vertical edge channel of the second SIP (100*b*), as shown in FIG. 13. In FIGS. 12C-13, top plate splines (300*b*, 3000 are inserted into the top edges of the SIPs (100, 100*b*) and secured with locking pins (400) to form flat top edge surfaces on the SIPs (100, 100*b*), completing the corner.

Figure 14A:
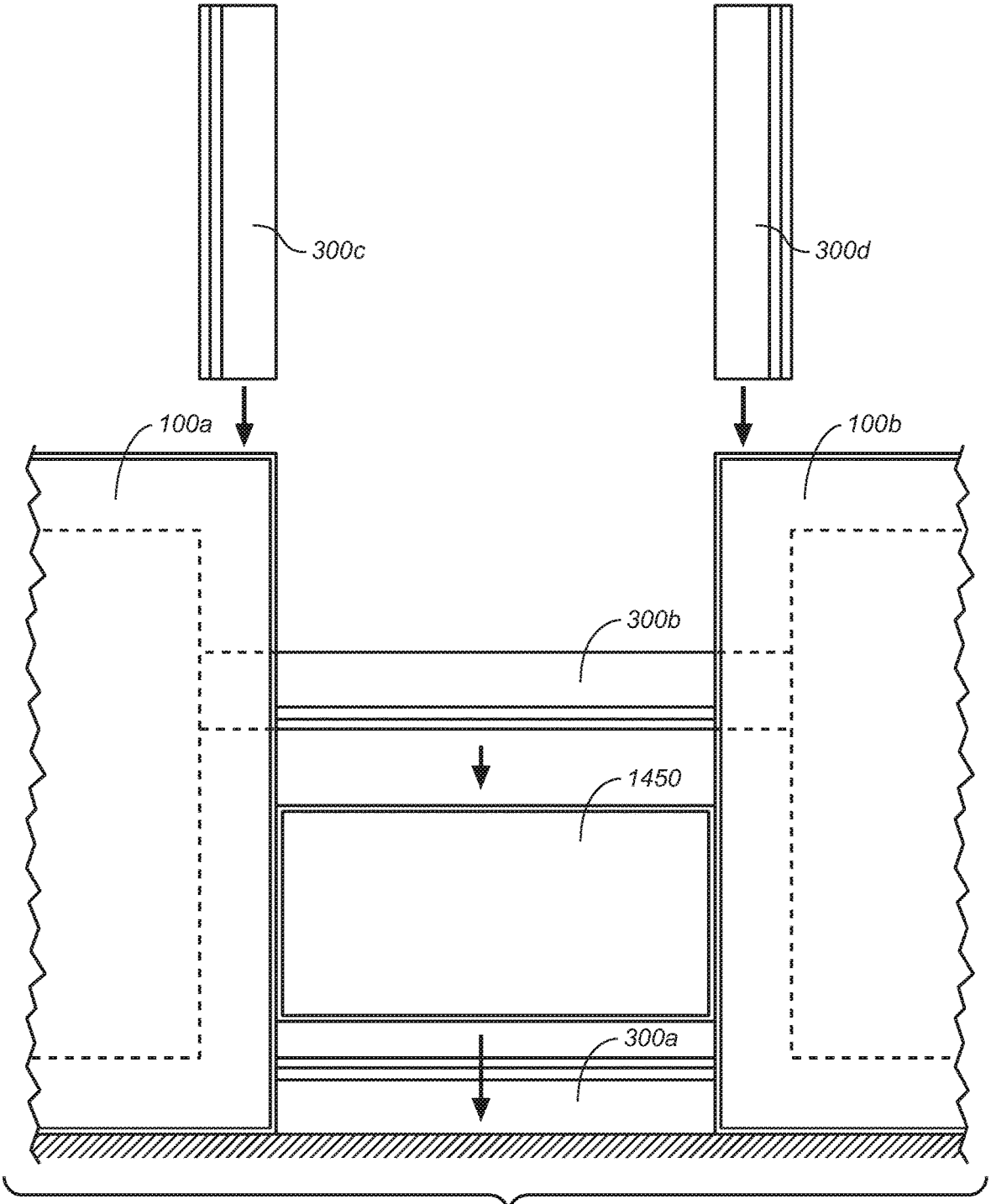
FIGS. 14A to 14C illustrate a method of assembling a window or door frame using the system of the invention.
Figure 14B:
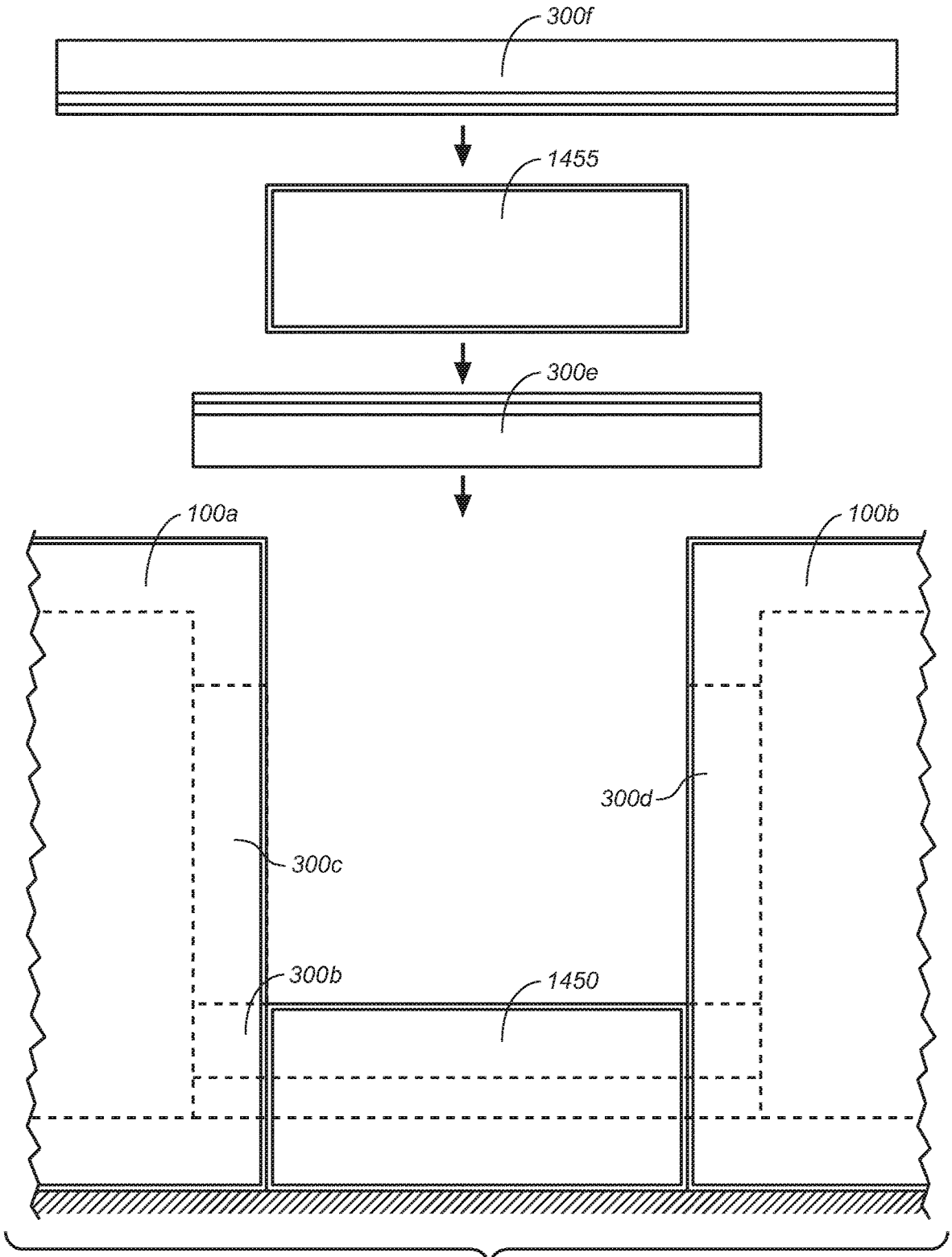
Figure 14C:
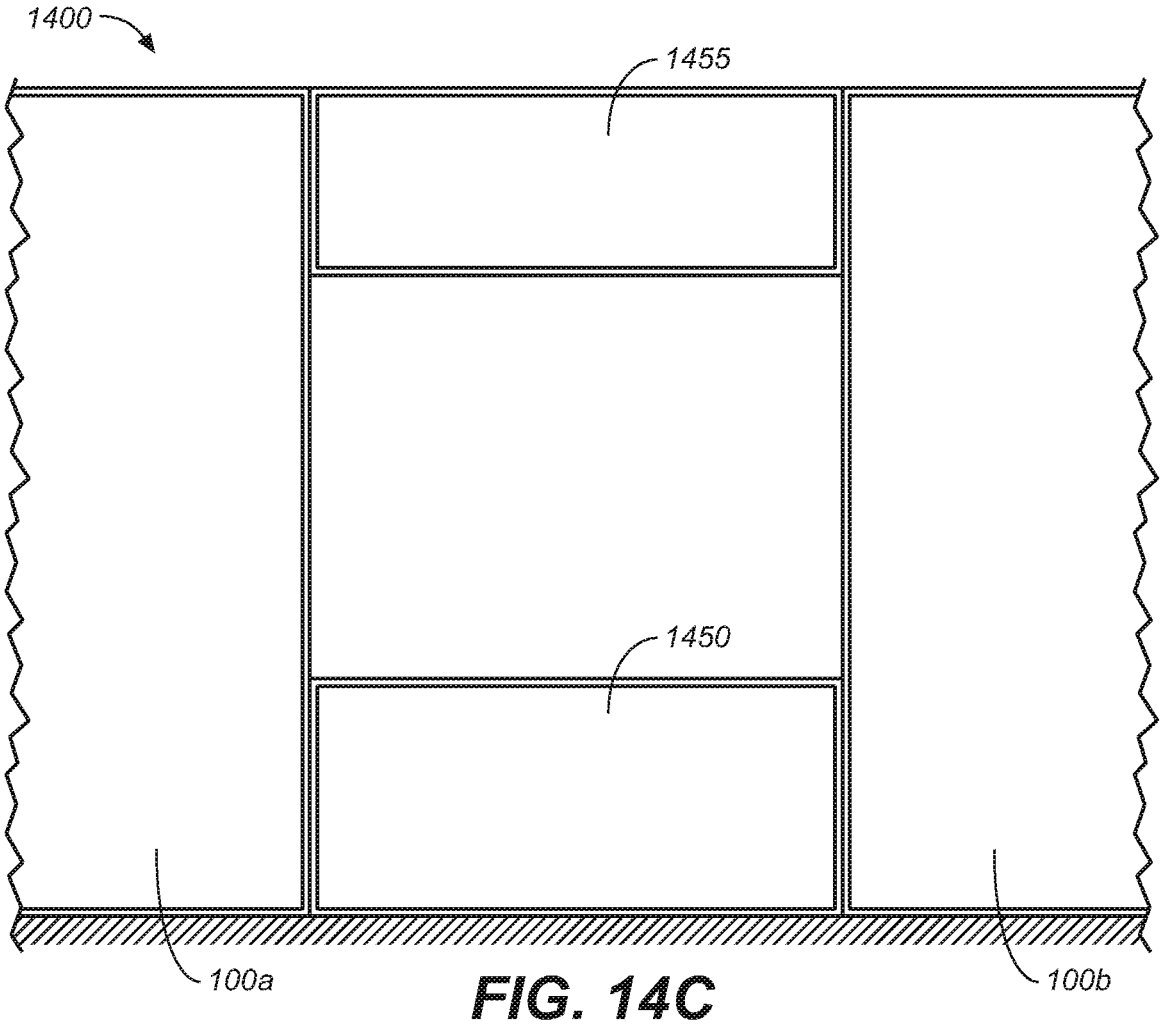

A method of assembling a window or door frame using the system of the invention is now discussed with respect to FIGS. 14A-14C.

In FIG. 14A, two wall SIPs (100*a*, 100*b*) are interconnected with a gap therebetween by a bottom plate spline (300*a*). A bottom frame SIP (1450) is installed on the bottom plate spline, (300*a*) and a first intermediate plate spline (300*b*) is installed in the top edge channel of the bottom frame SIP (1450). Vertical plate splines (300*c*, 300*d*) are then inserted into the vertical edge channels of the two wall SIPs (100*a*, 100*b*).

In FIG. 14B, a second intermediate plate spline (300*e*) is inserted into the vertical edge channels of the two wall SIPs (100*a*, 100*b*) where it rests on top of the vertical plate splines (300*c*, 300*d*) secured therein. A top frame SIP (1455) is then disposed on the second intermediate plate spline (300*e*) and a top plate spline (300*f*) is inserted into the top edges of the two wall SIPs (100*a*, 100*b*) and the second frame SIP (1455). Throughout the various steps of assembling, locking pins (not shown) are used to secure the interconnected wall components. The completed window or door frame (1400) is shown in FIG. 14C.

Figure 15:
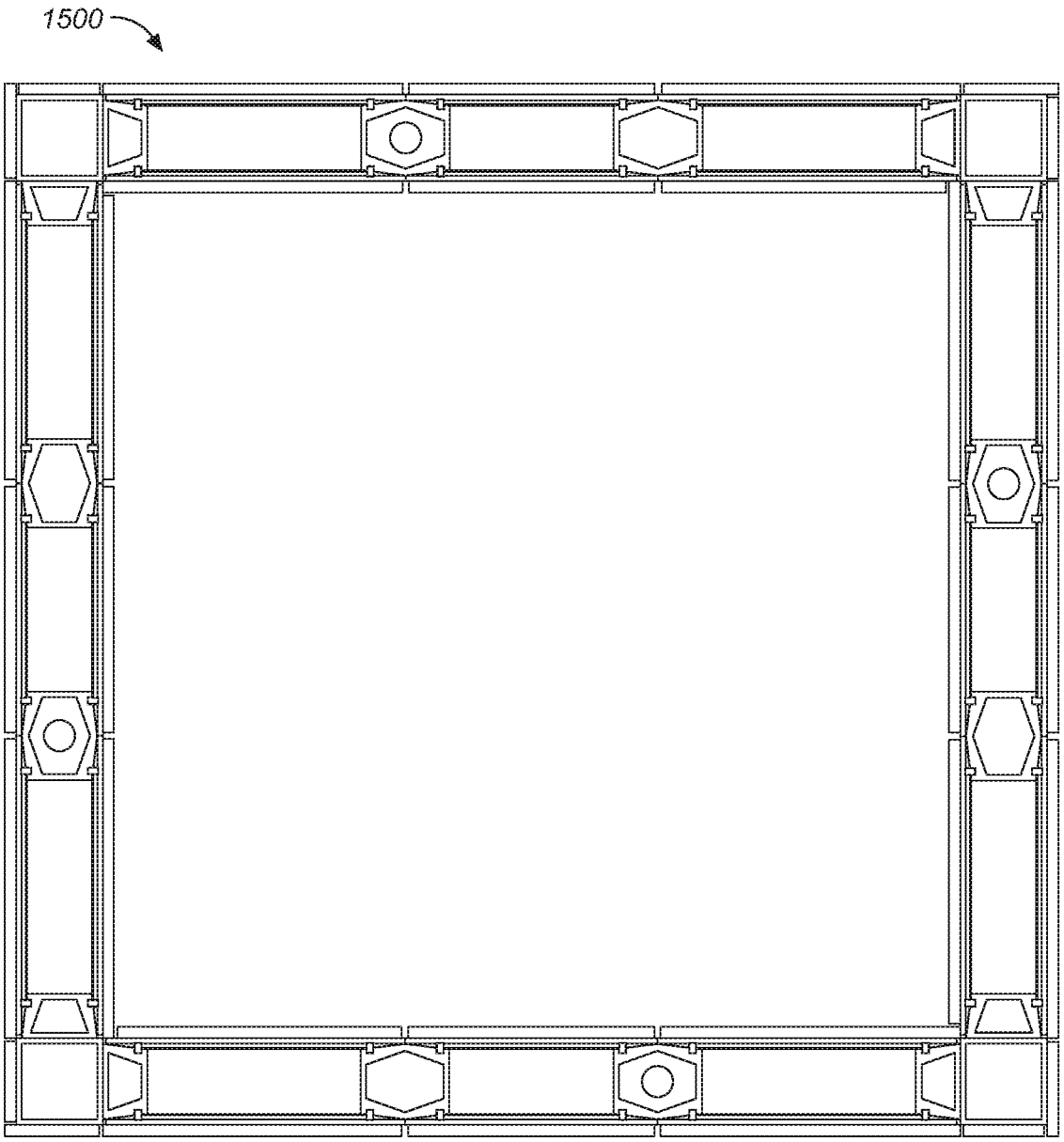
FIG. 15 shows a top plan view of a wall assembly constructed using the system of the invention.

FIG. 15 shows a top plan view of a wall assembly (1500) constructed according to the steps for constructing walls and corners as shown and described in FIGS. 9A-9C and 12A-12D.

Beyond use in building construction, the splines, hold-down blocks and locking pins of the invention can be sized for small-scale applications, such as for interconnecting the panels of a scale model or toy construction set.

Certain embodiments of a system and method for precisely aligning, interconnecting and securing SIPs have thus been described and illustrated herein in detail. These embodiments are merely exemplary implementations of the invention and are not to be taken as limiting, the spirit and scope of the invention being limited only by the terms of the appended claims and their legal equivalents.

I claim:

1. A system for assembling structural insulated panels, the system comprising:

a structural insulated panel (SIP) having one or more edges, at least one of said one or more edges including an edge channel extending into at least one of said one or more edges, the edge channel having an inner face and two opposing tapered surfaces extending between the inner face and the one or more edges, and an edge channel key slot extending into at least one of said opposing tapered surfaces, an alignment spline having symmetrical halves, each symmetrical half including two oppositely facing tapered faces complementary to the tapered surfaces of said edge channel and having an alignment spline key slot extending into at least one of said two oppositely facing tapered faces of said alignment spline, a locking pin, and an assembled configuration in which one of the symmetrical halves of the alignment spline is disposed in the edge channel of the SIP, the edge channel key slot is aligned with the alignment spline key slot cooperatively forming a locking channel, and the locking pin is disposed in the locking channel thereby securing the alignment spline to the SIP.

2. The system for assembling structural insulated panels of claim 1 wherein:

the alignment spline has a polygonal cross-section.

3. The system for assembling structural insulated panels of claim 2 wherein:

said polygonal cross-section is hexagonal.

4. The system for assembling structural insulated panels of claim 1 wherein: said one or more edges includes two side edges, each of said two side edges having a side edge channel.

5. The system for assembling structural insulated panels of claim 4 wherein: said one or more edges includes top and bottom edges, the top edge having a top edge channel, the bottom edge having a bottom edge channel, each of said top edge and bottom edge channels having two opposing tapered surfaces and an edge channel key slot extending into at least one of said two opposing tapered surfaces.

6. The system for assembling structural insulated panels of claim 5 further comprising:

a plate spline including an outer face and two oppositely facing tapered faces complementary to the two opposing tapered surfaces of said top and bottom edge channels, and a plate spline key slot extending into at least one said two oppositely facing tapered faces, and a second locking pin, wherein, in the assembled configuration, the plate spline is disposed in one of the top edge channel and the bottom edge channel, the plate spline key slot is aligned with the edge channel key slot of one of the two opposing tapered surfaces of said top or bottom edge channel to form a second locking channel, the second locking pin is disposed in the interior of the second locking channel thereby securing the plate spline to the SIP, and the outer face of the plate spline forms a flat surface along one of said top and bottom edges of the SIP.

7. The system for assembling structural insulated panels of claim 1 wherein:

the alignment spline has a hollow core.

8. The system for assembling structural insulated panels of claim 7 further comprising:

a hold-down block configured to be secured to a building foundation and configured to be disposed in the interior of the hollow core of said alignment spline for restriction of lateral movement of the alignment spline with respect to the building foundation.

9. The system for assembling structural insulated panels of claim 8 further comprising:

a fastening mechanism for securing the hold-down block to the building foundation, the alignment spline having a plurality of faces and an opening in one of said faces for providing access to the fastening mechanism for securing the hold-down block that has been received in the hollow core of the alignment spline to the building foundation.

10. A system for assembling structural insulated panels, the system comprising:

a structural insulated panel (SIP) having two oppositely facing side edges, an edge channel extending into at least one of the two side edges, the edge channel having an inner face and two opposing tapered surfaces extending between the inner face and the two oppositely facing side edges, and an edge channel key slot extending into at least one of said two opposing tapered surfaces, an alignment spline having a plurality of faces, a hollow core, and a hexagonal cross-section including symmetrical halves, each of said symmetrical halves including two oppositely facing tapered faces corresponding to the two opposing tapered surfaces of said edge channels and having an alignment spline key slot extending into at least one of said two oppositely facing tapered faces, a hold-down block configured to be secured to a building foundation and configured to fit into the hollow core of said alignment spline for restriction of lateral movement of the alignment spline with respect to the building foundation, one of said plurality of faces of said alignment spline having an opening for providing access to a fastening mechanism for securing said hold-down block received in the hollow core of the alignment spline to a building foundation, a locking pin, and an assembled configuration in which the hold-down block is disposed in the interior of the hollow core of the alignment spline and is secured to the building foundation, one of the halves of the alignment spline is disposed in the interior of one of the edge channels of the SIP, the edge channel key slot of said one of the edge channels is aligned with the alignment spline key slot of the alignment spline to form a locking channel, and the locking pin is disposed in the interior of the locking channel thereby securing the alignment spline to the SIP.

11. The system for assembling structural insulated panels of claim 10 wherein:

said SIP further includes top and bottom edges, each of said top and bottom edges including an edge channel.

12. The system for assembling structural insulated panels of claim 10 further comprising:

a plate spline having the shape of one of the halves of the alignment spline, the plate spline including an outer face and two oppositely facing tapered faces complementary to the two opposing tapered surfaces of said top and bottom edge channels and having a plate spline key slot extending into at least one of said two oppositely facing tapered faces, and a second locking pin, wherein, in the assembled configuration, the plate spline is disposed in one of the top edge channel and the bottom edge channel, the plate spline key slot is aligned with the edge channel key slot of one of the two opposing tapered surfaces of said top or bottom edge to form a second locking channel, the second locking pin is disposed in the interior of the second locking channel thereby securing the plate spline to the SIP, and the outer face of the plate spline forms a flat surface along one of said top and bottom edges of the SIP.

13. The system for assembling structural insulated panels of claim 1 wherein:

said SIP includes two spaced-apart parallel structural boards, said edge channel includes an inner face that is perpendicular to and extends between said structural boards, and said two opposing tapered surfaces extend between said inner face and said at least one edge.

14. The system for assembling structural insulated panels of claim 13 wherein:

the symmetrical halves extend from a middle of said alignment spline, each half of said alignment spline includes an outer face, and said two oppositely facing tapered faces extend from the middle of the alignment spline to the opposite end of said outer face.

15. The system for assembling structural insulated panels of claim 1 wherein:

said first edge channel key slot is facing inward toward said edge channel, and said alignment spline key slot is facing outward away from one of said two oppositely facing tapered faces of said alignment spline.

* * * * *